US006938980B2

(12) United States Patent
Yakura et al.

(10) Patent No.: US 6,938,980 B2
(45) **Date of Patent: *Sep. 6, 2005**

(54) IMAGE FORMING APPARATUS AND ITS CONTROL METHOD

(75) Inventors: Yuji Yakura, Kanagawa (JP); Kenji Suzuki, Kanagawa (JP); Hiroshi Tokunaga, Tokyo (JP); Shinichi Horii, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/617,285

(22) Filed: Jul. 10, 2003

(65) Prior Publication Data

US 2004/0125167 A1 Jul. 1, 2004

(30) Foreign Application Priority Data

Jul. 10, 2002 (JP) ..... 2002-201410

(51) Int. Cl.[7] ..... B41J 2/165

(52) U.S. Cl. ..... 347/29; 347/30; 347/33; 347/35

(58) Field of Search ..... 347/29, 30, 32, 347/31, 33, 35

(56) References Cited

U.S. PATENT DOCUMENTS 6,637,856 B2 * 10/2003 Nishi et al. ..... 347/29

* cited by examiner

*Primary Examiner*—Shih-Wen Hsieh
(74) *Attorney, Agent, or Firm*—Robert J. Depke; Trexler, Bushnell, Giangiorgi, Blackstone & Marr

(57) ABSTRACT

An image forming apparatus for forming an image on a recording medium includes a print head having ink-discharge surfaces having the ink-discharge openings therein; a cylindrical cleaning roller composed of an elastic material; moving means for moving the cleaning roller and the print head relative to each other while keeping the circumferential surface of the cleaning roller in contact with the ink-discharge surfaces; drive control means for controlling the moving means; a head cap for protecting the ink-discharge surfaces; cap opening/closing means for opening and closing the head cap. When the head cap is opened by the cap opening/closing means, by driving the moving means with control of the drive control means so as to move the cleaning roller relative to the print head while keeping the circumferential surface of the cleaning roller in contact with the ink-discharge surfaces, ink in the ink-discharge openings is sucked.

35 Claims, 15 Drawing Sheets

IMAGE FORMING APPARATUS AND ITS CONTROL METHOD

This application claims priority to Japanese Patent Application Number JP2002-201410 filed Jul. 10, 2002 which is incorporated herein by reference.

BACKGROUND OF THE INVENTION

1. Field of the Invention

The present invention relates to an image forming apparatus for forming an image on a recording medium by discharging ink from ink discharge openings and also to its control method.

2. Description of the Related Art

An inkjet-type image forming apparatus, for example, an inkjet printer, has been widely used because of its advantages such as a low operating cost, easy colorization of a print image, and easy miniaturization of the apparatus. The inkjet printer is designed to form an image by discharging a minute amount of ink from each of fine ink discharge openings formed in corresponding ink-discharge surfaces of a print head. Unless the printer has continued a printing operation for a long time interval and hence has discharged ink from the ink discharge openings of the print head for that time interval, ink discharged during the last printing operation and accreted in the ink-discharge openings and the vicinities thereof of the ink-discharge surfaces may evaporate into high viscosity or solidification, thereby blocking ink from being discharged normally.

On this account, in the known inkjet printer, the print head is cleaned by pressing a blade made from a slightly hard rubber or the like onto the ink-discharge surfaces of the print head and by sliding the blade across the ink-discharge surfaces so as to remove (i.e., to wipe out) ink accreted on the ink-discharge surfaces with the ink having a high viscosity or been solidified. In association with this, Japanese Unexamined Patent Application Publication No. 57-34969 has disclosed a technique in which a plurality of blades are fixed to a rotating shaft and a wiping effect is improved by rotating the blades.

However, since ink accreted on the ink-discharge surfaces is wiped by pressing the blade made from a slightly hard rubber or the like onto the ink-discharge surfaces of the print head and by sliding the blade across the ink-discharge surfaces in such a known related art, a large force is exerted on the ink-discharge surfaces by the blade, thereby sometimes resulting in damaging the ink-discharge surfaces.

Also, when the above blade is used, it is expected to perform its duty depending on only its wiping effect; however, its wiping operation is not enough to solve a problem in that ink sometimes remains in the ink-discharge openings and the vicinities thereof. Even when the plurality of blades are used, the ink-discharge surfaces are sometimes damaged and also ink sometimes remains in the ink-discharge openings and the vicinities thereof in a similar fashion to the former case.

SUMMARY OF THE INVENTION

Accordingly, it is an object of the present invention to provide an image forming apparatus in which, when a cap member for protecting ink-discharge surfaces is opened or closed by cap opening/closing means, by moving a cleaning member relative to a print head while keeping the circumferential surface of the cleaning member in contact with the ink-discharge surfaces, the ink-discharge openings and the vicinities thereof are effectively cleaned without damaging the ink-discharge surfaces, and also it is another object of the present invention to provide a control method of an image forming apparatus.

In order to achieve the above objects, the present invention has been made.

An image forming apparatus according to the present invention is equipped with a print head including ink-discharge surfaces having ink-discharge openings formed therein; a cylindrical cleaning member composed of an elastic material; moving means for moving the cleaning member and the print head relative to each other while keeping the circumferential surface of the cleaning member in contact with the ink-discharge surfaces of the print head; drive control means for controlling the moving means; a cap member for protecting the ink-discharge surfaces of the print head; and cap opening/closing means for opening and closing the cap member. When the cap member is opened by the cap opening/closing means, by driving the moving means with control of the drive control means so as to move the cleaning member and the print head relative to each other while keeping the circumferential surface of the cleaning member in contact with the ink-discharge surfaces, ink in the ink-discharge openings is sucked.

With this structure, when the cap member is opened by the cap opening/closing means, by driving the moving means with control of the drive control means so as to move the cleaning member and the print head relative to each other while keeping the circumferential surface of the cleaning member in contact with the ink-discharge surfaces of the print head, due to the elastic deformation of the cleaning member during the moving, ink in the ink-discharge openings is sucked and removed. Thus, the ink-discharge openings and the vicinities thereof are effectively cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; moving means for moving the cleaning member and the print head relative to each other while keeping the circumferential surface of the cleaning member in contact with the ink-discharge surfaces of the print head; drive control means for controlling the moving means; discharge control means for controlling an discharge operation of ink from the ink-discharge openings formed in the discharge surfaces; a cap member for protecting the ink-discharge surfaces of the print head; and cap opening/closing means for opening and closing the cap member. When the cap member is opened by the cap opening/closing means, by driving the moving means with control of the drive control means so as to move the cleaning member and the print head relative to each other while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

With this structure, when the cap member is opened by the cap opening/closing means, by driving the moving means with control of the drive control means so as to move the cleaning member and the print head relative to each other while keeping the circumferential surface of the cleaning member in contact with the ink-discharge surfaces of the print head, due to the elastic deformation of the cleaning member during the moving, ink in the ink-discharge openings is sucked, and after the moving of the cleaning member on the ink-discharge surfaces, ink is preliminarily discharged from the ink-discharge openings with control of the discharge control means. Thus, due to the absorption of ink in the ink-discharge openings and the subsequent preliminary discharge of ink, the ink-discharge openings and the vicinities thereof are effectively cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; moving means for moving the cleaning member and the print head relative to each other while keeping the circumferential surface of the cleaning member in contact with the ink-discharge surfaces of the print head; drive control means for controlling the moving means; discharge control means for controlling an discharge operation of ink from the ink-discharge openings formed in the discharge surfaces; a cap member for protecting the ink-discharge surfaces of the print head; and cap opening/closing means for opening and closing the cap member. When the cap member is opened by the cap opening/closing means, by performing a discharge operation of ink from the ink-discharge openings with control of the discharge control means, ink is preliminarily discharged from the ink-discharge openings.

With this structure, when the cap member is opened by the cap opening/closing means, by performing a discharge operation of ink from the ink-discharge openings with control of the discharge control means, ink is preliminarily discharged from the ink-discharge openings. Thus, the ink-discharge openings and the vicinities thereof are effectively cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; a cap member for housing the cleaning member therein and for protecting the ink-discharge surfaces of the print head; cap opening/closing means for opening and closing the cap member and for moving the cleaning member and the print head relative to each other in accordance with the opening operation of the cap member while keeping the circumferential surface of the cleaning member in contact with the ink-discharge surfaces of the print head; and drive control means for controlling the cap opening/closing means. When the cap member is opened by the cap opening/closing means, by driving the cap opening/closing means with control of the drive control means so as to move the cleaning member and the print head relative to each other while keeping the circumferential surface of the cleaning member in contact with the ink-discharge surfaces, ink in the ink-discharge openings is sucked.

With this structure, when the cap member is opened by the cap opening/closing means, by driving the cap opening/closing means with control of the drive control means so as to move the cleaning member and the print head relative to each other while keeping the circumferential surface of the cleaning member in contact with the ink-discharge surfaces of the print head, due to the elastic deformation of the cleaning member during the moving, ink in the ink-discharge openings is sucked and removed. Thus, the ink-discharge openings and the vicinities thereof are effectively cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; a cap member for housing the cleaning member therein and for protecting the ink-discharge surfaces of the print head; cap opening/closing means for opening and closing the cap member and for moving the cleaning member and the print head relative to each other in accordance with the opening operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces. When the cap member is opened by the cap opening/closing means, by driving the cap opening/closing means with control of the drive control means so as to move the cleaning member and the print head relative to each other while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

With this structure, when the cap member is opened by the cap opening/closing means, by driving the cap opening/closing means with control of the drive control means so as to move the cleaning member and the print head relative to each other while keeping the circumferential surface of the cleaning member in contact with the ink-discharge surfaces of the print head, due to the elastic deformation of the cleaning member during the moving, ink in the ink-discharge openings is sucked, and after the moving of the cleaning member on the ink-discharge surfaces, ink is preliminarily discharged from the ink-discharge openings with control of the discharge control means. Thus, due to the absorption of ink in the ink-discharge openings and the subsequent preliminary discharge of ink, the ink-discharge openings and the vicinities thereof are effectively cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; a cap member for housing the cleaning member therein and for protecting the ink-discharge surfaces of the print head; cap opening/closing means for opening and closing the cap member and for moving the cleaning member and the print head relative to each other in accordance with the opening operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces. When the cap member is opened by the cap opening/closing means, by performing a discharge operation of ink from the ink-discharge openings with control of the discharge control means, ink is preliminarily discharged from the ink-discharge openings.

With this structure, when the cap member is opened by the cap opening/closing means, by performing a discharge operation of ink from the ink-discharge openings with control of the discharge control means, ink is preliminarily discharged from the ink-discharge openings. Thus, the ink-discharge openings and the vicinities thereof are effectively cleaned without damaging the ink-discharge surfaces of the print head.

Also, an image forming apparatus according to the present invention is provided with a print head including ink-discharge surfaces having a plurality of rows of the ink-discharge openings formed therein for a corresponding plurality of colors; a cylindrical cleaning member composed of an elastic material; a cap member for housing the cleaning member therein and for protecting the ink-discharge surfaces of the print head; cap opening/closing means for opening and closing the cap member and for moving the cleaning member and the print head relative to each other in the direction orthogonal to the plurality of rows of the ink-discharge openings for the respective colors in accordance with the opening operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces. When the cap member is opened by the cap opening/closing means, by driving the cap opening/closing means with control of the drive control means so as to move the cleaning member and the print head relative to each other while keeping the circumferential surface of the cleaning member in contact with the ink-discharge surfaces, ink in the ink-discharge openings is sucked, and in the order of the rows, over which the cleaning member passes with control of the discharge control means, of the ink-discharge openings for the corresponding colors formed in the ink-discharge surfaces, ink is preliminarily discharged from the ink-discharge openings with control of the discharge control means.

With this structure, when the cap member is opened by the cap opening/closing means, by driving the cap opening/closing means with control of the drive control means so as to open the cap member for housing the cylindrical cleaning member therein composed of an elastic material and for protecting the ink-discharge surfaces of the print head and also to move the cleaning member and the print head relative to each other in the direction orthogonal to the plurality of rows of the ink-discharge openings for the respective colors in accordance with the opening operation of the cap member while keeping the circumferential surface of the cleaning member in contact with the ink-discharge surfaces of the print head, ink in the ink-discharge openings is sucked due to the elastic deformation of the cleaning member during the moving, and ink is preliminarily discharged from the ink-discharge openings with control of the discharge control means in the order of the rows, over which the cleaning member passes with control of the discharge control means, of the ink-discharge surfaces for the respective colors. Thus, due to the absorption of ink in the ink-discharge openings and the subsequent preliminary discharge of ink, the ink-discharge openings and the vicinities thereof are effectively cleaned without damaging the ink-discharge surfaces of the print head.

An image forming apparatus according to the present invention is provided with a print head including ink-discharge surfaces having ink-discharge openings formed therein; a cylindrical cleaning member composed of an elastic material; moving means for moving the cleaning member and the print head relative to each other while keeping the circumferential surface of the cleaning member in contact with the ink-discharge surfaces of the print head; drive control means for controlling the moving means; a cap member for protecting the ink-discharge surfaces of the print head; and cap opening/closing means for opening and closing the cap member. When the cap member is closed by the cap opening/closing means, by driving the moving means with control of the drive control means so as to move the cleaning member and the print head relative to each other while keeping the circumferential surface of the cleaning member in contact with the ink-discharge surfaces, ink in the ink-discharge openings is sucked.

With this structure, when the cap member is closed by the cap opening/closing means, by driving the moving means with control of the drive control means so as to move the cleaning member and the print head relative to each other while keeping the circumferential surface of the cleaning member in contact with the ink-discharge surfaces of the print head, ink in the ink-discharge openings is sucked and removed due to the elastic deformation of the cleaning member during the moving. Thus, the ink-discharge openings and the vicinities thereof are effectively cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; moving means for moving the cleaning member and the print head relative to each other while keeping the circumferential surface of the cleaning member in contact with the ink-discharge surfaces of the print head; drive control means for controlling the moving means; discharge control means for controlling an discharge operation of ink from the ink-discharge openings formed in the discharge surfaces; a cap member for protecting the ink-discharge surfaces of the print head; and cap opening/closing means for opening and closing the cap member. When the cap member is closed by the cap opening/closing means, by driving the moving means with control of the drive control means so as to move the cleaning member and the print head relative to each other while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

With this structure, when the cap member is closed by the cap opening/closing means, by driving the moving means with control of the drive control means so as to move the cleaning member and the print head relative to each other while keeping the circumferential surface of the cleaning member in contact with the ink-discharge surfaces of the print head, ink in the ink-discharge openings is sucked due to the elastic deformation of the cleaning member during the moving, and after the moving of the cleaning member on the ink-discharge surfaces, ink is preliminarily discharged from the ink-discharge openings with control of the discharge control means. Thus, due to the absorption of ink in the ink-discharge openings and the subsequent preliminary discharge of ink, the ink-discharge openings and the vicinities thereof are cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; moving means for moving the cleaning member and the print head relative to each other while keeping the circumferential surface of the cleaning member in contact with the ink-discharge surfaces of the print head; drive control means for controlling the moving means; discharge control means for controlling an discharge operation of ink from the ink-discharge openings formed in the discharge surfaces; a cap member for protecting the ink-discharge surfaces of the print head; and cap opening/closing means for opening and closing the cap member. When the cap member is closed by the cap opening/closing means, by performing a discharge operation of ink from the ink-discharge openings with control of the discharge control means, ink is preliminarily discharged from the ink-discharge openings.

With this structure, when the cap member is closed by the cap opening/closing means, by performing a discharge operation of ink from the ink-discharge openings with control of the discharge control means, ink is preliminarily discharged from the ink-discharge openings. Thus, the ink-discharge openings and the vicinities thereof are effectively cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; a cap member for housing the cleaning member therein and for protecting the ink-discharge surfaces of the print head; cap opening/closing means for opening and closing the cap member and for moving the cleaning member and the print head relative to each other in accordance with the closing operation of the cap member while keeping the circumferential surface of the cleaning member in contact with the ink-discharge surfaces of the print head; and drive control means for controlling the cap opening/closing means. When the cap member is closed by the cap opening/closing means, by driving the cap opening/closing means with control of the drive control means so as to move the cleaning member and the print head relative to each other while keeping the circumferential surface of the cleaning member in contact with the ink-discharge surfaces, ink in the ink-discharge openings is sucked.

With this structure, when the cap member is closed by the cap opening/closing means, by driving the cap opening/closing means with control of the drive control means so as to move the cleaning member and the print head relative to each other while keeping the circumferential surface of the cleaning member in contact with the ink-discharge surfaces of the print head, ink in the ink-discharge openings is sucked and removed due to the elastic deformation of the cleaning member during the moving. Thus, the ink-discharge openings and the vicinities thereof are effectively cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; a cap member for housing the cleaning member therein and for protecting the ink-discharge surfaces of the print head; cap opening/closing means for opening and closing the cap member and for moving the cleaning member and the print head relative to each other in accordance with the closing operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces. When the cap member is closed by the cap opening/closing means, by driving the cap opening/closing means with control of the drive control means so as to move the cleaning member and the print head relative to each other while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

With this structure, when the cap member is closed by the cap opening/closing means, by driving the cap opening/closing means with control of the drive control means so as to move the cleaning member and the print head relative to each other while keeping the circumferential surface of the cleaning member in contact with the ink-discharge surfaces of the print head, ink in the ink-discharge openings is sucked due to the elastic deformation of the cleaning member during the moving, and after the moving of the cleaning member on the ink-discharge surfaces, ink is preliminarily discharged from the ink-discharge openings with control of the discharge control means. Thus, due to the absorption of ink in the ink-discharge openings and the subsequent preliminary discharge of ink, the ink-discharge openings and the vicinities thereof are cleaned without damaging the ink-discharge surfaces of the print head.

Also, an image forming apparatus according to the present invention is provided with a print head including ink-discharge surfaces having ink-discharge openings formed therein; a cylindrical cleaning member composed of an elastic material; a cap member for housing the cleaning member therein and for protecting the ink-discharge surfaces of the print head; cap opening/closing means for opening and closing the cap member and for moving the cleaning member and the print head relative to each other in accordance with the closing operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces. When the cap member is closed by the cap opening/closing means, by performing a discharge operation of ink from the ink-discharge openings with control of the discharge control means, ink is preliminarily discharged from the ink-discharge openings.

With this structure, when the cap member is closed by the cap opening/closing means, by performing a discharge operation of ink from the ink-discharge openings with control of the discharge control means, ink is preliminarily discharged from the ink-discharge openings. Thus, the ink-discharge openings and the vicinities thereof are effectively cleaned without damaging the ink-discharge surfaces of the print head.

Also, an image forming apparatus according to the present invention is provided with a print head including ink-discharge surfaces having a plurality of rows of the ink-discharge openings formed therein for a corresponding plurality of colors; a cylindrical cleaning member composed of an elastic material; a cap member for housing the cleaning member therein and for protecting the ink-discharge surfaces of the print head; cap opening/closing means for opening and closing the cap member and for moving the cleaning member and the print head relative to each other in the direction orthogonal to the plurality of rows of the ink-discharge openings for the respective colors in accordance with the closing operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces. When the cap member is closed by the cap opening/closing means, by driving the cap opening/closing means with control of the drive control means so as to move the cleaning member and the print head relative to each other while keeping the circumferential surface of the cleaning member in contact with the ink-discharge surfaces, ink in the ink-discharge openings is sucked, and in the order of the rows, over which the cleaning member passes with control of the discharge control means, of the ink-discharge openings for the corresponding colors formed in the ink-discharge surfaces, ink is preliminarily discharged from the ink-discharge openings with control of the discharge control means.

With this structure, when the cap member is closed by the cap opening/closing means, by driving the cap opening/closing means with control of the drive control means so as to close the cap member for housing the cylindrical cleaning member therein composed of an elastic material and for protecting the ink-discharge surfaces of the print head and to move the cap member and the print head relative to each other in the direction orthogonal to the plurality of rows of the ink-discharge openings for the respective colors in accordance with the closing operation of the cap member while keeping the circumferential surface of the cleaning member in contact with the ink-discharge surfaces of the print head, ink in the ink-discharge openings is sucked due to the elastic deformation of the cleaning member during the moving, and ink is preliminarily discharged from the ink-discharge openings with control of the discharge control means in the order of the rows, over which the cleaning member passes with control of the discharge control means, of the ink-discharge surfaces for the respective colors. Thus, due to the absorption of ink in the ink-discharge openings and the subsequent preliminary discharge of ink, the ink-discharge openings and the vicinities thereof are effectively cleaned without damaging the ink-discharge surfaces of the print head.

Also, A control method of an image forming apparatus according to the present invention includes the step of controlling the image forming apparatus such that, when a cap member is opened by cap opening/closing means, by driving moving means with control of drive control means so as to move a cylindrical cleaning member composed of an elastic material while keeping the circumferential surface of the cleaning member in contact with ink-discharge surfaces of a print head, having ink-discharge openings formed therein, ink in the ink-discharge openings is sucked.

Thus, the ink-discharge openings and the vicinities thereof are effectively cleaned without damaging the ink-discharge surfaces of the print head.

Also, A control method of an image forming apparatus according to the present invention includes the step of controlling the image forming apparatus such that, when a cap member is opened by cap opening/closing means, by driving moving means with control of drive control means so as to move a cylindrical cleaning member composed of an elastic material while keeping the circumferential surface of the cleaning member in contact with ink-discharge surfaces of a print head, having ink-discharge openings formed therein, ink in the ink-discharge openings is sucked, and after the moving of the cleaning member on the ink-discharge surfaces, ink is preliminarily discharged from the ink-discharge openings with control of discharge control means.

Thus, the ink-discharge openings and the vicinities thereof can be effectively cleaned without damaging the ink-discharge surfaces of the print head due to the absorption of ink in the ink-discharge openings and the subsequent preliminary discharge of ink.

Also, A control method of an image forming apparatus according to the present invention includes the step of controlling the image forming apparatus such that, when a cap member is opened by cap opening/closing means, by performing a discharge operation of ink from ink-discharge openings formed in ink-discharge surfaces of a print head with control of discharge control means, ink is preliminarily discharged from the ink-discharge openings.

Thus, the ink-discharge openings and the vicinities thereof can be effectively cleaned without damaging the ink-discharge surfaces of the print head.

Also, A control method of an image forming apparatus according to the present invention includes the step of controlling the image forming apparatus such that, when a cap member is opened by cap opening/closing means, by driving the cap opening/closing means with control of drive control means so as to move a cylindrical cleaning member composed of an elastic material while keeping the circumferential surface of the cleaning member in contact with ink-discharge surfaces of a print head, having ink-discharge openings formed therein, ink in the ink-discharge openings is sucked.

Thus, the ink-discharge openings and the vicinities thereof can be effectively cleaned without damaging the ink-discharge surfaces of the print head.

Also, A control method of an image forming apparatus according to the present invention includes the step of controlling the image forming apparatus such that, when a cap member is opened by cap opening/closing means, by driving the cap opening/closing means with control of drive control means so as to move a cylindrical cleaning member composed of an elastic material while keeping the circumferential surface of the cleaning member in contact with ink-discharge surfaces of a print head, having ink-discharge openings formed therein, ink in the ink-discharge openings is sucked, and after the moving of the cleaning member on the ink-discharge surfaces with control of discharge control means, ink is preliminarily discharged from the ink-discharge openings.

Thus, due to the absorption of ink in the ink-discharge openings and the subsequent preliminary discharge of ink, the ink-discharge openings and the vicinities thereof are effectively cleaned without damaging the ink-discharge surfaces of the print head.

Also, A control method of an image forming apparatus according to the present invention includes the step of controlling the image forming apparatus such that, when a cap member is opened by cap opening/closing means, by performing a discharge operation of ink from ink-discharge openings formed in ink-discharge surfaces of a print head with control of discharge control means, ink is preliminarily discharged from the ink-discharge openings.

Thus, the ink-discharge openings and the vicinities thereof are effectively cleaned without damaging the ink-discharge surfaces of the print head of the print head.

Also, A control method of an image forming apparatus according to the present invention includes the step of controlling the image forming apparatus such that, when a cap member is opened by cap opening/closing means, by driving the cap opening/closing means with control of drive control means so as to move a cleaning member composed of an elastic material while keeping the circumferential surface of the cleaning member in contact with ink-discharge surfaces of a print head, having a plurality of rows of ink-discharge openings formed therein for a corresponding plurality of colors, ink in the ink-discharge openings is sucked, and in the order of the rows, over which the cleaning member passes with control of discharge control means, of the ink-discharge openings for the respective colors formed in the ink-discharge surfaces, ink is preliminarily discharged from the ink-discharge openings.

Thus, due to the absorption of ink in the ink-discharge openings and the subsequent preliminary discharge of ink, the ink-discharge openings and the vicinities thereof are effectively cleaned without damaging the ink-discharge surfaces of the print head.

Also, A control method of an image forming apparatus according to the present invention includes the step of controlling the image forming apparatus such that, when a cap member is closed by cap opening/closing means, by driving moving means with control of drive control means so as to move a cylindrical cleaning member composed of an elastic material while keeping the circumferential surface of the cleaning member in contact with ink-discharge surfaces of a print head, having ink-discharge openings formed therein, ink in the ink-discharge openings is sucked.

Thus, the ink-discharge openings and the vicinities thereof are effectively cleaned without damaging the ink-discharge surfaces of the print head.

Also, A control method of an image forming apparatus according to the present invention includes the step of controlling the image forming apparatus such that, when a cap member is closed by cap opening/closing means, by driving moving means with control of drive control means so as to move a cylindrical cleaning member composed of an elastic material while keeping the circumferential surface of the cleaning member in contact with ink-discharge surfaces of a print head, having ink-discharge openings formed therein, ink in the ink-discharge openings is sucked, and after the moving of the cleaning member on the ink-discharge surfaces with control of discharge control means, ink is preliminarily discharged from the ink-discharge openings.

Thus, due to the absorption of ink in the ink-discharge openings and the subsequent preliminary discharge of ink, the ink-discharge openings and the vicinities thereof are effectively cleaned without damaging the ink-discharge surfaces of the print head.

Also, A control method of an image forming apparatus according to the present invention includes the step of controlling the image forming apparatus such that, when the cap member is closed by cap opening/closing means, by performing a discharge operation of ink from ink-discharge openings formed in ink-discharge surfaces of a print head with control of discharge control means, ink is preliminarily discharged from the ink-discharge openings.

Thus, the ink-discharge openings and the vicinities thereof are effectively cleaned without damaging the ink-discharge surfaces of the print head.

Also, A control method of an image forming apparatus according to the present invention includes the step of controlling the image forming apparatus such that, when a cap member is closed by cap opening/closing means, by driving the cap opening/closing means with control of drive control means so as to move a cylindrical cleaning member composed of an elastic material while keeping the circumferential surface of the cleaning member in contact with ink-discharge surfaces of a print head, having ink-discharge openings formed therein, ink in the ink-discharge openings is sucked.

Thus, the ink-discharge openings and the vicinities thereof are effectively cleaned without damaging the ink-discharge surfaces of the print head.

Also, A control method of an image forming apparatus according to the present invention includes the step of controlling the image forming apparatus such that, when a cap member is closed by cap opening/closing means, by driving the cap opening/closing means with control of drive control means so as to move a cylindrical cleaning member composed of an elastic material while keeping the circumferential surface of the cleaning member in contact with ink-discharge surfaces of a print head, having ink-discharge openings formed therein, ink in the ink-discharge openings is sucked, and after the moving of the cleaning member on the ink-discharge surfaces with control of discharge control means, ink is preliminarily discharged from the ink-discharge openings.

Thus, due to the absorption of ink in the ink-discharge openings and the subsequent preliminary discharge of ink, the ink-discharge openings and the vicinities thereof are effectively cleaned without damaging the ink-discharge surfaces of the print head.

Also, A control method of an image forming apparatus according to the present invention includes the step of controlling the image forming apparatus such that, when a cap member is closed by cap opening/closing means, by performing a discharge operation of ink from ink-discharge openings formed in ink-discharge surfaces of a print head with control of discharge control means, ink is preliminarily discharged from the ink-discharge openings.

Thus, the ink-discharge openings and the vicinities thereof are effectively cleaned without damaging the ink-discharge surfaces of the print head.

Also, A control method of an image forming apparatus according to the present invention includes the step of controlling the image forming apparatus such that, when a cap member is closed by cap opening/closing means, by driving the cap opening/closing means with control of drive control means so as to move a cleaning member composed of an elastic material while keeping the circumferential surface of the cleaning member in contact with ink-discharge surfaces of a print head, having a plurality of rows of ink-discharge openings formed therein for a corresponding plurality of colors, ink in the ink-discharge openings is sucked, and in the order of the rows, over which the cleaning member passes with control of discharge control means, of the ink-discharge openings for the respective colors formed in the ink-discharge surfaces, ink is preliminarily discharged from the ink-discharge openings.

Thus, due to the absorption of ink in the ink-discharge openings and the subsequent preliminary discharge of ink, the ink-discharge openings and the vicinities thereof are effectively cleaned without damaging the ink-discharge surfaces of the print head.

DESCRIPTION OF THE PREFERRED EMBODIMENTS

Embodiments of the present invention will be described with reference to the accompanying drawings.

Figure 1:
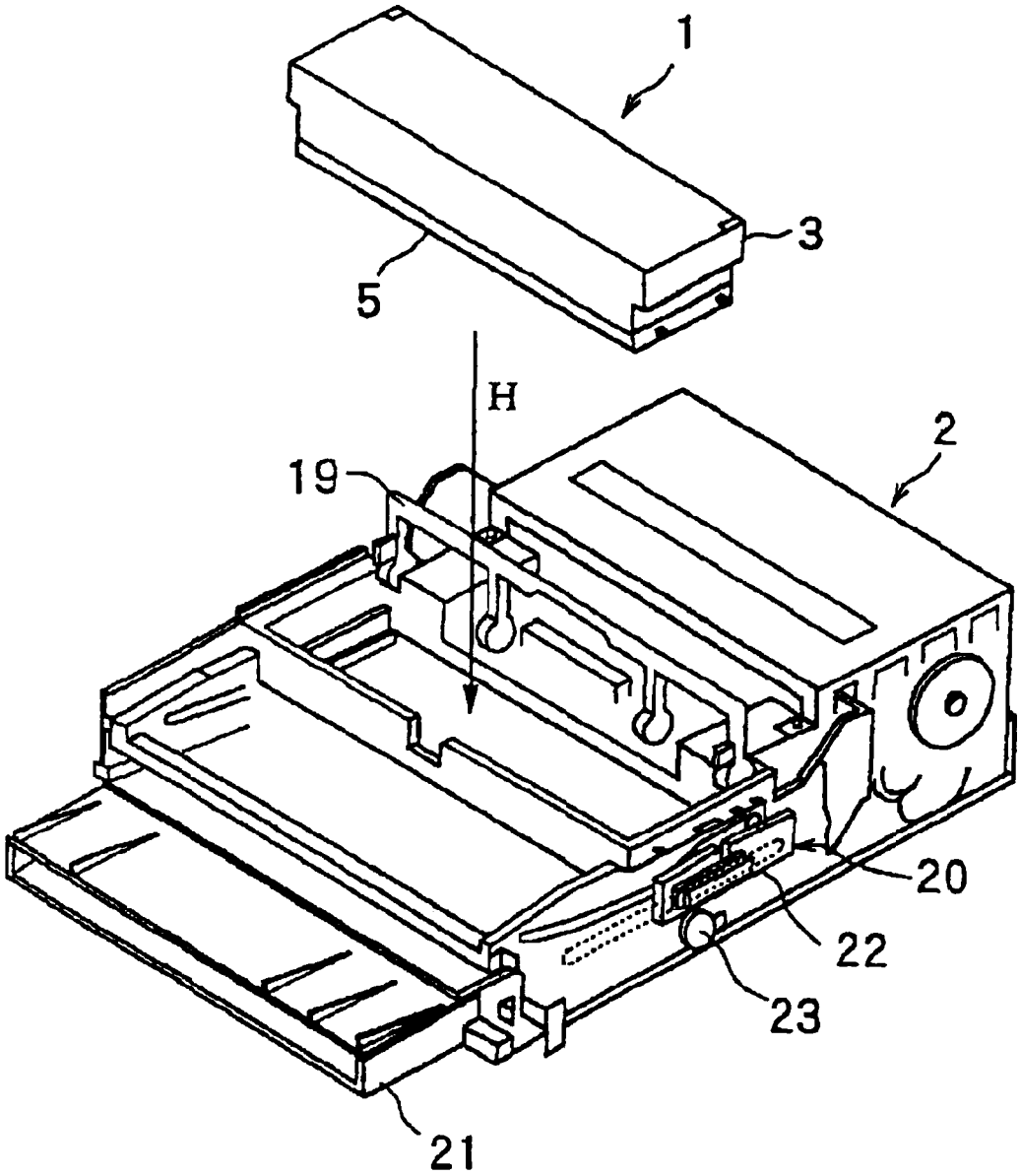
FIG. 1 is a perspective view of an image forming apparatus, taking an inkjet printer for example, according to an embodiment of the present invention.

FIG. 1 is a perspective view of an image forming apparatus, taking an inkjet printer for example, according to an embodiment of the present invention. The ink-jet printer is of a type in which an inkjet head 1 is removal and is directly mounted in a main body 2 of the printer. Also, the inkjet printer has a structure in which the ink-jet head 1 is inserted in the direction of the arrow H indicated in the drawing and fixedly set in the main body 2 of the printer.

Figure 2:
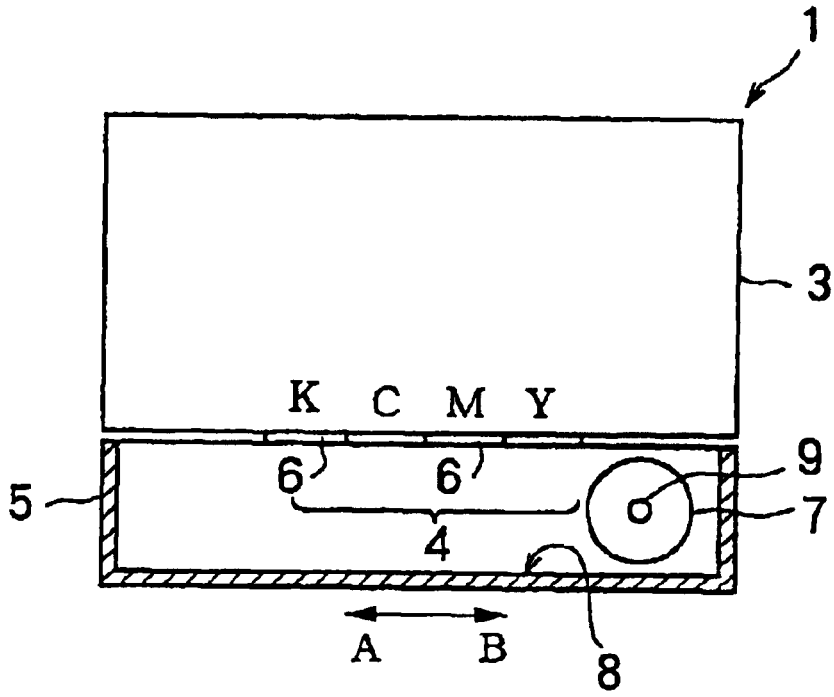
FIG. 2 is a magnified transverse sectional view of an inkjet head shown in FIG. 1.

The inkjet head 1 is intended to finely particularize liquid ink by, for example, an electrothermal transducing method or an electromechanical transducing method and to discharge it so as to form ink dots on a recording sheet (a recording medium), and, as shown in FIGS. 1 and 2, has an ink cartridge 3, a print head 4, and a head cap 5.

The ink cartridge 3 is intended to contain ink for a single color or a plurality of colors, and has a case having a long slender shape and extending along the width direction of the main body 2 of the printer shown in FIG. 1, that is, extending through the overall width of a recording sheet along the width direction thereof. Although not shown in the drawing, the above-mentioned case has, for example, four separate ink chambers therein for containing ink for four colors, namely, yellow Y, magenta M, cyan C, and black K. The ink cartridge 3 is composed of a hard resin or the like.

As shown in FIG. 2 which is a magnified transverse sectional view of the inkjet head 1 shown in FIG. 1, the ink cartridge 3 has the print head 4 disposed on the bottom surface thereof. The print head 4 is intended to finely particulate ink fed from the ink cartridge 3 and to discharge it, and has ink-discharge surfaces 6 having fine ink-discharge openings perforated therein along the longitudinal direction of the ink cartridge 3 so as to correspond to the overall width of a recording sheet.

Each of the ink-discharge surfaces 6 is composed of, for example, nickel and material including nickel and is formed by nickel-electroforming so as to have a thin sheet-like shape. The ink-discharge surfaces 6 extend in the longitudinal direction of the ink cartridge 3 and have four rows of the ink-discharge openings formed therein for corresponding four colors of yellow Y, magenta M, cyan C, and black K so as to provide a four-color integrated line scan head.

Although not shown in the drawing, the ink-discharge surfaces 6 have portions having the rows of ink-discharge openings formed therein for the respective Y, M, C, and K colors and have other portions, each pair of the other portions having the corresponding row of ink-discharge openings sandwiched therebetween, having projections covering head electrodes with resin formed thereon such that these two types of portions are formed so as to provide an undulating surface.

The ink cartridge 3 has the head cap 5 fixed on the bottom surface side thereof. The head cap 5 has a cleaning roller 7 housed therein, which will be described later, and serves as a cap member for covering the ink-discharge surfaces 6 of the print head 4 so as to prevent the ink-discharge openings from drying and clogging. Also, the head cap 5 has a long slender shape having the same length as that of the case of the ink cartridge 3; has a shallow box-like shape with an open top; and is mounted so as to be movable relative to and detachable from the print head 4.

The head cap 5 is moved by moving means such as a motor or the like in the directions of the arrows A and B indicated in the drawing, which are orthogonal to the longitudinal direction of the ink-discharge surfaces 6 of the print head 4; is removed from the ink cartridge 3 while being moved in the direction of the arrow A; and is mounted again on the ink cartridge 3 while being returned in the direction of the arrow B. The head cap 5 is composed of a hard resin or the like.

The head cap 5 has the cleaning roller 7 disposed therein.

The cleaning roller 7 serves as a cleaning member for cleaning the ink-discharge surfaces 6 of the print head 4. The cleaning roller 7 having a cylindrical shape is composed of an elastic material; is fixed in the head cap 5 along one of the side surfaces and in the longitudinal direction of the of the head cap 5; and accordingly lies parallel to the longitudinal direction of the ink-discharge surfaces 6 of the print head 4. Thus, the cleaning roller 7 moves together with the head cap 5 in the direction of the arrow A so as to clean the ink-discharge surfaces 6 of the print head 4.

The head cap 5 also has an ink receiver 8 disposed therein. The ink receiver 8 is intended to receive ink preliminarily discharged from the ink-discharge openings of the print head 4 on a part of the bottom or the entire bottom of the shallow box-shaped head cap 5.

Figure 3:
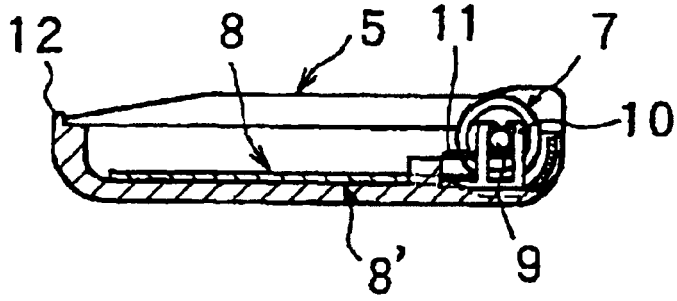
FIG. 3 is a side view of operative examples of a head cap, a cleaning roller, and an ink receiver shown in FIG. 2.
Figure 4:
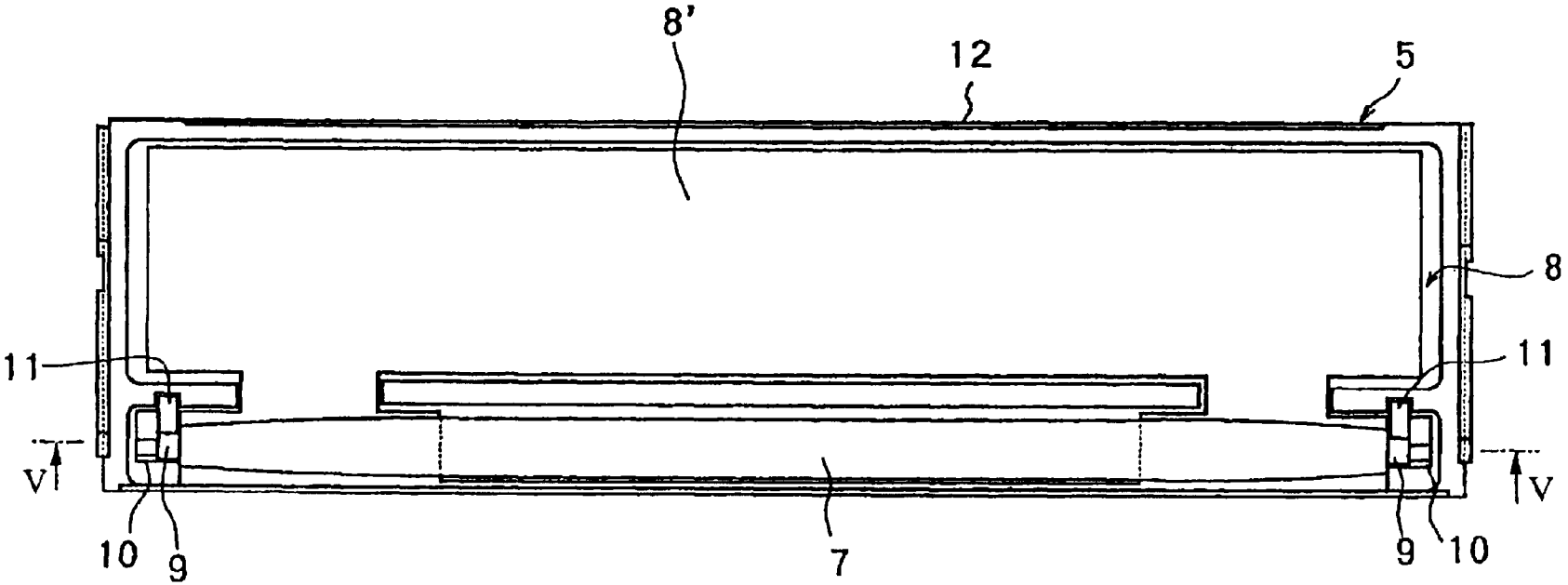
FIG. 4 is a plan view of the operative examples of the head cap, the cleaning roller, and the ink receiver.
Figure 5:
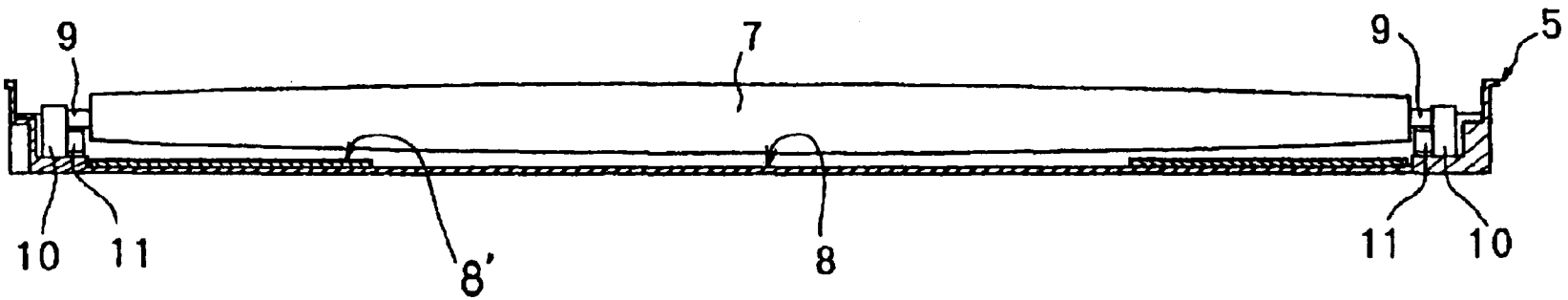
FIG. 5 is a sectional view taken along the line V—V indicated in FIG. 4.

Referring now to FIGS. 3 to 5, operative examples of the head cap 5 and the cleaning roller 7 will be described. In the state shown in FIG. 4, first, the head cap 5 is formed so as to have a long slender shape in concert with the width and the length of the ink cartridge 3 shown in FIG. 1, and as shown in FIG. 3, also to have a shallow box-like shape having a bottom, side walls standing along the entire circumference thereof, and an open top.

As previously mentioned, the head cap 5 moves in the directions of the arrows A and B which are orthogonal to the longitudinal direction of the ink-discharge surfaces 6 of the print head 4. As means for positioning the head cap 5 when it is mounted again on the ink cartridge 3 while being returned in the direction of the arrow B, the head cap 5 has a positioning claw 12 disposed at the top end of the side wall thereof on the opposite side of the cleaning roller 7, as shown in FIG. 3. The positioning claw 12 is retained at the under edge of the ink cartridge 3 so that the head cap 5 is positioned.

In the vicinity of one side wall of the head cap 5 lying close to the print head 4 and along the longitudinal direction of the head cap 5, the cylindrical cleaning roller 7 lying in contact with the ink-discharge surfaces 6 of the print head 4 across its overall length is removably held. More particularly, as shown in FIG. 4, the cleaning roller 7 has a pair of pins 9 disposed in a protruding manner at both ends thereof, and these pins 9 are held by a pair of respective holding members 10 having an approximate U-shape, as shown in FIG. 3.

Each holding member 10 has a pin-receiving portion at the top thereof which can be elastically opened and closed. By pressing down the pins 9 into the corresponding pin-receiving portions, the pin-receiving portions are opened and the pins 9 are thus received. Then, the pin-receiving portions are closed and the pins 9 are hence held. On the other hand, by lifting up the pins 9, the pin-receiving portions are opened so that the pins 9 can be removed.

Meanwhile, the cylindrical cleaning roller 7 has a so-called crown shape which becomes gradually thicker toward its central part in the longitudinal direction thereof, as shown in FIGS. 4 and 5. With this crown shape, the cleaning roller 7 is prevented from coming out of contact with the ink-discharge surfaces 6 caused by the downward deformation, which would otherwise occur, of the central part of the cleaning roller 7 with respect to the longitudinal direction thereof.

A portion of the cleaning roller 7 lying in contact with the ink-discharge surfaces 6 is composed of an elastic material such as rubber. In other words, while the core portion of the cleaning roller 7 is composed of, for example, metal or a hard resin, the cylindrical surface portion outside the core portion is composed of an elastic member such as rubber. The cleaning roller 7 may be entirely composed of an elastic member such as rubber.

As shown in FIG. 3, a pair of floating springs 11 are disposed at portions of the head cap 5 for holding the cleaning roller 7 to the head cap 5. The floating springs 11 serve as means for urging the cleaning roller 7 toward the ink-discharge surfaces 6 of the print head 4, each spring made from a leaf spring having, for example, an approximate U-shape in side view, and are inserted in the vicinities of the corresponding holding members 10 and below the corresponding pin 9. Thus, since the urging forces of the floating springs 11 are exerted on the corresponding pins 9 at both ends of the cleaning roller 7, the cleaning roller 7 is pressed against the ink-discharge surfaces 6 of the print head 4 with an almost uniform pressure.

With this structure, as shown in FIG. 2, with the head cap 5 being fixed on the bottom surface side of the ink cartridge 3, the urging forces of the floating springs 11 and the elastic force and the crown shape of the cleaning roller 7 cause the cleaning roller 7 to remain in contact with the ink-discharge surfaces 6 of the print head 4 across its overall length. The floating springs 11 are not limited to a leaf spring having an approximate U-shape; alternatively, they may be made from a coil spring.

Also, the cleaning roller 7 rolls due to its contact with the ink-discharge surfaces 6 of the print head 4. Hence, as shown in FIG. 2, when the head cap 5 moves in the direction of the arrow A, the cleaning roller 7 rolls in close contact with the ink-discharge surfaces 6 of the print head 4 through its length with an appropriate pressure and thus removes ink accreted on the ink-discharge surfaces 6 due to its rolling movement.

Figure 6A:
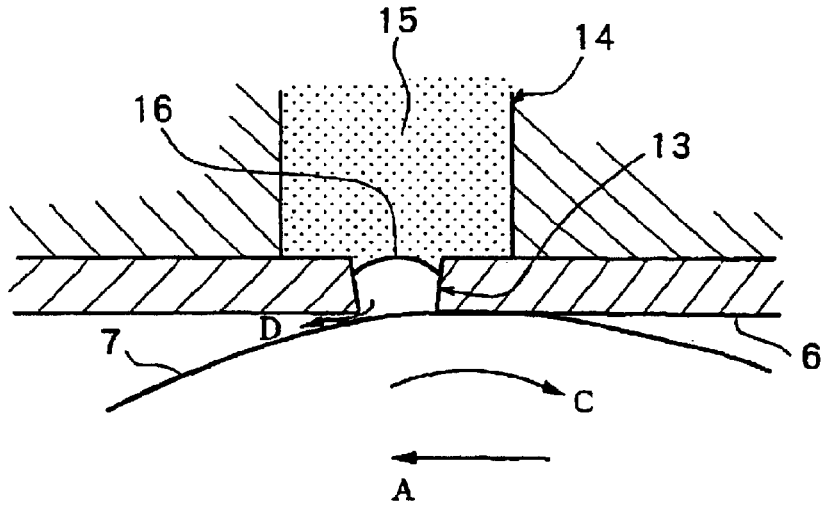
FIGS. 6A to 6C are magnified sectional views illustrating a cleaning operation of an ink-discharge surface of a print head by the cleaning roller.
Figure 6B:
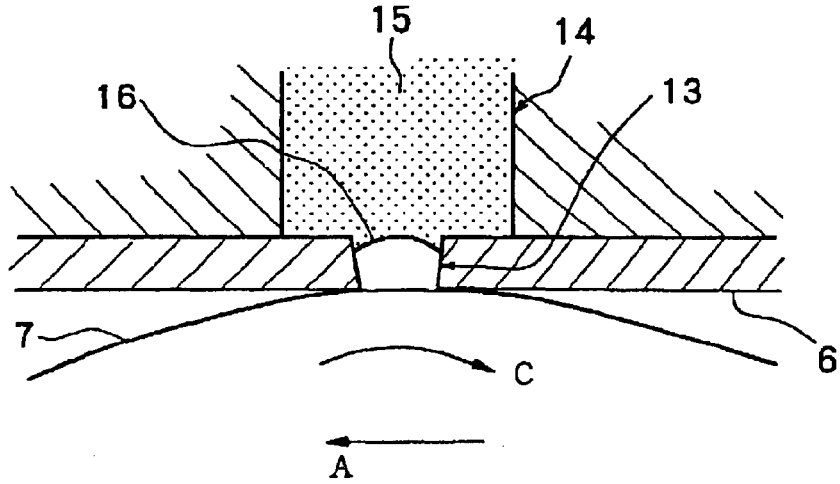
Figure 6C:
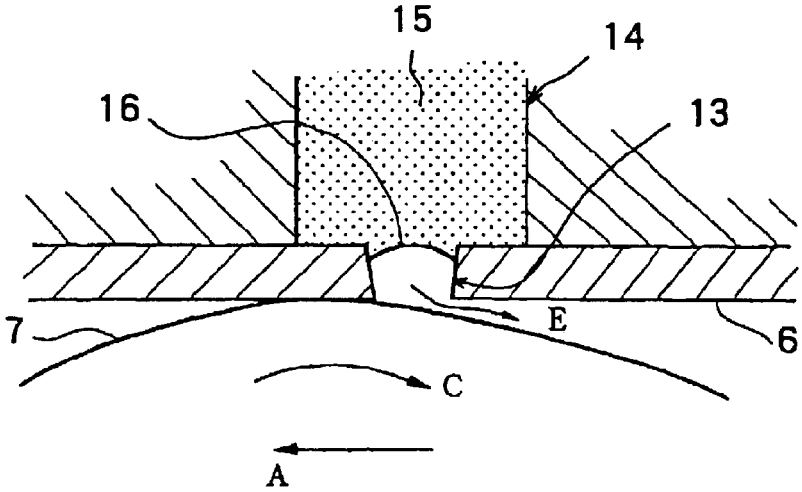

Referring now to FIGS. 6A to 6C, a cleaning operation of the cleaning roller 7 for the ink-discharge surfaces 6 of the print head 4 will be described. FIGS. 6A to 6C are sectional views in which one of the ink-discharge surfaces 6, one of ink-discharge openings 13, and the cleaning roller 7 are magnified for easy explanation. First, it is assumed in the states shown in FIGS. 6A to 6C that the cleaning roller 7 rolls in the direction of the arrow C indicated in the drawing due to its contact with the ink-discharge surfaces 6 while moving together with the head cap 5 shown in FIG. 2 in the direction of the arrow A, and that the cleaning roller 7 is to pass over one of the rows of the ink-discharge openings 13 formed in the ink-discharge surfaces 6 of the print head 4 shown in FIG. 2.

FIG. 6A illustrates a state in which the cleaning roller 7 moving in the direction of the arrow A while rolling in the direction of the arrow C is close to the row of the ink-discharge openings 13. In this state, each ink-discharge opening 13 is filled with ink 15 from an ink chamber 14, and a meniscus 16 having a concave curve is formed in the ink-discharge opening 13 due to the surface tension of the ink 15.

As shown in FIG. 6A, when moving in the direction of the arrow A while rolling in the direction of the arrow C, the cleaning roller 7 blocks the ink-discharge opening 13 beginning from its one edge toward its other edge, and in the meantime, air in the ink-discharge opening 13 is pushed out through the gap at the other edge as indicated by the arrow D.

Next, as shown in FIG. 6B, moving further in the direction of the arrow A while rolling in the direction of the arrow C and when arriving just at the ink-discharge opening 13, the cleaning roller 7 completely blocks the ink-discharge opening 13.

In this state, since the cleaning roller 7 is pressed against and lies in contact with the ink-discharge surfaces 6, microscopically, a part of the surface of the cleaning roller 7 lying between the one edge and the other edge of the ink-discharge opening 13 intrudes into the ink-discharge opening 13 a slight amount due to its elasticity; accordingly, with air in the ink-discharge opening 13 being pushed out just by that much, the cleaning roller 7 blocks the entrance of the ink-discharge opening 13 and hermetically seals the inside space thereof.

Then, as shown in FIG. 6C, the cleaning roller 7 moves further in the direction of the arrow A while rolling in the direction of the arrow C and opens the one edge of the ink-discharge opening 13 with the other edge being blocked. In this state, microscopically, when the part of the surface of the cleaning roller 7 intruding into the ink-discharge opening 13 a slight amount detaches from the one edge of the ink-discharge openings 13, air hermetically sealed in the ink-discharge opening 13 is sucked and flows out through a gap of the one edge as indicated by the arrow E.

More particularly, due to a change in pressure in the ink-discharge opening 13 from a state (a positive pressure state) in which a slight amount of air in the ink-discharge opening 13 is pushed out and the remaining air is hermetically sealed as shown in FIG. 6B to another state (a negative pressure state) in which the air in the ink-discharge opening 13 is sucked as shown in FIG. 6C, the ink in the ink-discharge openings 13 is sucked. With this arrangement, in the state shown in FIG. 2, a sucking force is exerted on ink remaining in the ink-discharge openings 13 so as to withdraw the ink out from the print head 4, whereby the ink remaining in the ink-discharge openings 13 is sucked and reliably removed.

In this case, since the cylindrical cleaning roller 7 composed of an elastic material such as rubber moves on the ink-discharge surfaces 6, the ink-discharge surfaces 6 can be cleaned without damaging a resin protective layer covering the head electrodes of the ink-discharge surfaces 6.

Although, in the above description, the cleaning roller 7 rolls due to its contact with the ink-discharge surfaces 6 of the print head 4, it may be fixed so as not to roll while being kept in contact with the ink-discharge surfaces 6.

For example, in the state shown in FIG. 3, when the two pins 9 are formed at both ends of the cleaning roller 7 so as to extend vertically and are inserted in the approximately U-shaped grooves of the corresponding holding members 10, the cleaning roller 7 does not roll. In this case, since the cleaning roller 7 moves while rubbing against the ink-discharge surfaces 6, not only liquid ink accreted on the ink-discharge surfaces 6 but also highly viscous ink or solidified ink clogged on the same can be removed.

Also, the cleaning roller 7 may be formed so as to roll while rubbing against the ink-discharge surfaces 6 of the print head 4 by limiting its rolling with a brake mechanism. For example, in the state shown in FIG. 3, since this brake mechanism is constructed such that appropriate elastic bodies are disposed at the portions of the holding members 10 where the pins 9 disposed at both ends of the cleaning roller 7 are held so as to press-fit the pins 9 into corresponding holes formed in the elastic bodies, or such that both end surfaces of the cleaning roller 7 are pressed into contact with the corresponding side surfaces of the elastic bodies, an appropriate brake force is generated during the rolling of the cleaning roller 7.

In this case, since the cleaning roller 7 rolls little by little while rubbing against the ink-discharge surfaces 6, not only liquid ink accreted on the ink-discharge surfaces 6 but also highly viscous ink or solidified ink clogged on the same can be removed without damaging the ink-discharge surfaces 6.

The ink receiver 8 disposed inside the head cap 5 has an ink-absorbing member 8' laid on the receiving surface of the ink receiver 8 serving as the bottom surface of the head cap 5, as shown in FIGS. 3 to 5. The ink-absorbing member 8' serves as means for preventing rebound of ink preliminarily discharged from the print head 4; is composed of a porous polymeric material such as sponge, polyurethane, or formed polyurethane; and is laid on substantially the entire receiving surface of the ink receiver 8, as shown in FIG. 4. Meanwhile, as shown in FIG. 5, the ink-absorbing member 8' is not laid below the central part of the crown-shaped cleaning roller 7, having a large diameter so as not to come into contact with the central part.

When the ink-absorbing member 8' is laid in the above-mentioned manner, ink preliminarily discharged from the print head 4 shown in FIG. 2 is prevented from rebounding and also the ink is absorbed so as not to be stored in the ink receiver 8. Thus, the preliminarily discharged ink is prevented from rebounding off the ink receiver 8 and accordingly from accreting again on the ink-discharge surfaces 6. Also, when the ink-absorbing member 8' has absorbed the preliminarily discharged ink after used for a reasonable time interval, by removing it from the ink receiver 8 and by replacing it with a new one, the preliminarily discharged ink can be easily removed.

Although, in the embodiment illustrated in FIGS. 3 to 5, the entire bottom surface of the head cap 5 is used as the ink receiver 8 by way of example, the present invention is not limited to this arrangement, and a part of the bottom surface may be used as the ink receiver 8. For example, in the state shown in FIG. 2, by shifting the cleaning roller 7 a little toward the center of the head cap 5 so as to provide a partition between the cleaning roller 7 and the side wall of the head cap 5 close to the cleaning roller 7, a chamber enclosed by the partition and the above-mentioned wall may be used as the ink receiver 8. In such a case, a space for receiving ink preliminarily discharged from the ink-discharge openings of the print head 4 can be limited to a specific portion of the head cap 5.

Next, preliminary discharge of ink from the ink-discharge openings of the print head 4 will be described. The preliminary discharge of ink is performed, for example, by sucking and removing ink in the ink-discharge openings, prior to a printing operation of characters and/or pictures in order to prevent the above-described situation in which the ink in the ink-discharge openings evaporates to high viscosity or solidification and, as a result, is prevented from being normally discharged. Ink is preliminarily discharged from the ink-discharge openings toward the ink receiver 8 of the head cap 5 after the ink-discharge surfaces 6 are cleaned by the cleaning roller 7.

For example, the preliminary discharge is performed by repeating several times of discharging ink droplets from the ink-discharge openings of the print head 4 at a frequency of about 10 kHz.

In the state shown in FIG. 2, in order to avoid color mixture caused by cleaning the ink-discharge surfaces 6 for the respective colors with the above-mentioned single cleaning roller 7, when the preliminary discharge of ink is performed after cleaning the ink-discharge surfaces 6 for the respective colors, it is necessary to control the timing of the preliminary discharge of ink.

Figure 7:
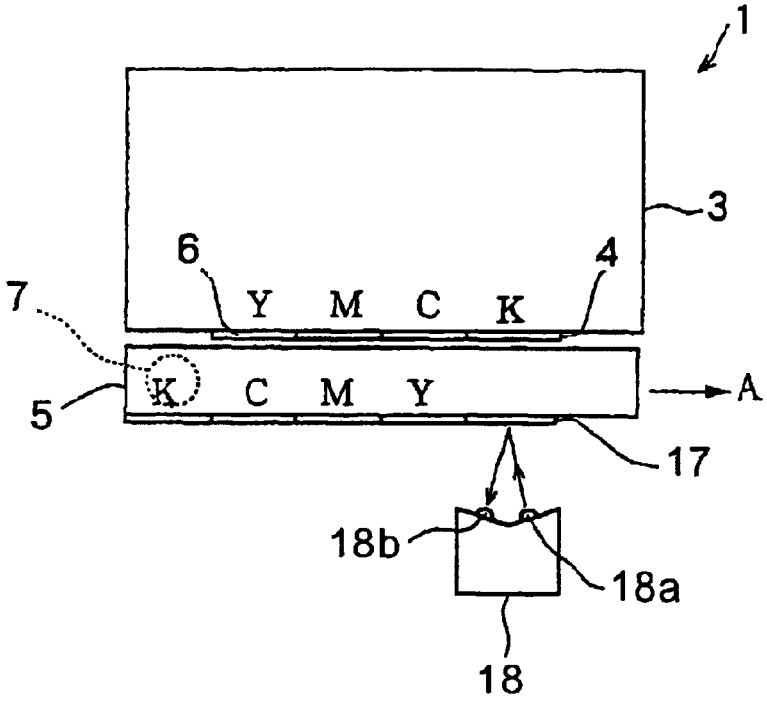
FIG. 7 illustrates means for detecting the timing of preliminary discharge of ink from ink-discharge openings, which is performed when the head cap moves relative to the print head.

To achieve this, as shown in FIG. 7, the head cap 5 has means for detecting the timing of the preliminary discharge of ink from the ink-discharge openings of the print head 4 while the head cap 5 is moving relative to the print head 4. Meanwhile, FIG. 7 illustrates a state in which the head cap 5 moves in the opposite direction to that shown in FIG. 2.

The means for detecting the timing of the preliminary discharge of ink is formed by position-detecting sheets 17 disposed on the lower surface side of the head cap 5 and a photoelectric switch 18 disposed in the main body 2 of the printer shown in FIG. 1 so as to face the position-detecting sheets 17, as shown in FIG. 7. The position-detecting sheets 17 are intended to determine a position of the head cap 5 corresponding to each of the ink-discharge surfaces 6 of the print head 4 for the respective colors when the head cap 5 is moving in the direction of the arrow A.

For example, a light-dark pattern is formed in concert with the array pitch of the ink-discharge surfaces 6 for the respective colors Y, M, C, and K, and the array of the pattern is arranged in the opposite direction to the order of the colors Y, M, C, and K of the ink-discharge surfaces 6. Also, in the initial moving state of the head cap 5, the array of the pattern of the position-detecting sheets 17 is shifted backward with respect to the direction of the arrow A.

The photoelectric switch 18 is intended to detect the light-dark pattern of the position-detecting sheets 17 moving together with the head cap 5 and is an integral combination of a photo emitter 18*a* made from, for example, a light emitting diode (LED), and a photo detector 18*b* made from a photo diode. The light-dark pattern of the position-detecting sheets 17 has a reflectance variable with the wavelength of light emitted from the photo emitter 18*a*, and the photo detector 18*b* is also sensitive to the wavelength of the reflected light.

With this structure, when the position-detecting sheets 17 under the head cap 5 pass in front of the photoelectric switch 18 while the head cap 5 is moving in the direction of the arrow A, the light-dark pattern of the position-detecting sheets 17 is detected and the positions of the position-detecting sheets 17 corresponding to the ink-discharge surfaces 6 for the respective colors Y, M, C, and K are thus determined.

Thus, since the position of the cleaning roller 7 moving together with the head cap 5 is obtained, the sequential timing of the preliminarily discharge of ink from each of the ink-discharge openings is controlled immediately after the ink-discharge surfaces 6 for the respective colors are cleaned by the cleaning roller 7. In this state, the preliminarily discharged ink is reliably received in the ink receiver 8.

Figure 8A:
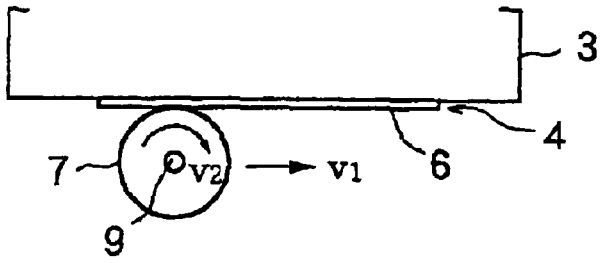
FIGS. 8A and 8B schematically illustrate a modification of the cleaning roller.
Figure 8B:
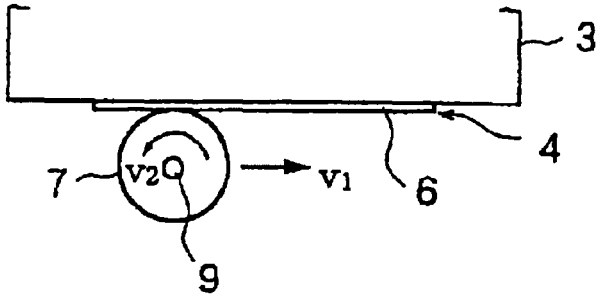

FIGS. 8A and 8B schematically illustrate a modification of the cleaning roller 7. In this modification, the cleaning roller 7 is driven to rotate by a drive mechanism for rotation in the normal or reverse direction. More particularly, in the state shown in FIG. 2, the rotating shaft of a motor (not shown) disposed in the main body 2 of the printer is coupled with the pins 9 of the cleaning roller 7 via a gear mechanism having an appropriate reduction ratio so as to actively drive the cleaning roller 7 for rotation.

Thus, as shown in FIG. 8A, the cleaning roller 7 is driven to rotate by the above-mentioned motor in the same direction as the moving direction of the head cap 5 indicated by the arrow A shown in FIG. 7, and also the number of rotations of the motor is arranged such that the peripheral speed v2 of the cleaning roller 7 is greater than the moving speed v1 of the head cap 5. In this case, a difference in the speeds between the ink-discharge surfaces 6 of the print head 4 and the circumferential surface of the cleaning roller 7 causes to rub against each other; as a result, the ink-discharge surfaces 6 are reliably cleaned. Also, even when the number of rotations of the motor is arranged such that the moving speed v1 of the head cap 5 is greater than the circumferential speed v2 of the cleaning roller 7, likewise as described above, the ink-discharge surfaces 6 and the circumferential surface of the cleaning roller 7 are caused to rub against each other; accordingly, the ink-discharge surfaces 6 are reliably cleaned.

Alternatively, as shown in FIG. 8B, the cleaning roller 7 may be rotated in the opposite direction to the moving direction of the head cap 5 indicated by the arrow A shown in FIG. 7. In this case, a difference in the moving directions between the ink-discharge surfaces 6 of the print head 4 and the circumferential surface of the cleaning roller 7 causes to rub against each other; as a result, the ink-discharge surfaces 6 are reliably cleaned.

As described above, in the case of the modification of the cleaning roller 7 shown in FIGS. 8A and 8B, the ink-discharge surfaces 6 of the print head 4 are cleaned with new portions of the circumferential surface of the cleaning roller 7, which are successively rolled out due to the active rotation of the cleaning roller 7.

Figure 9:
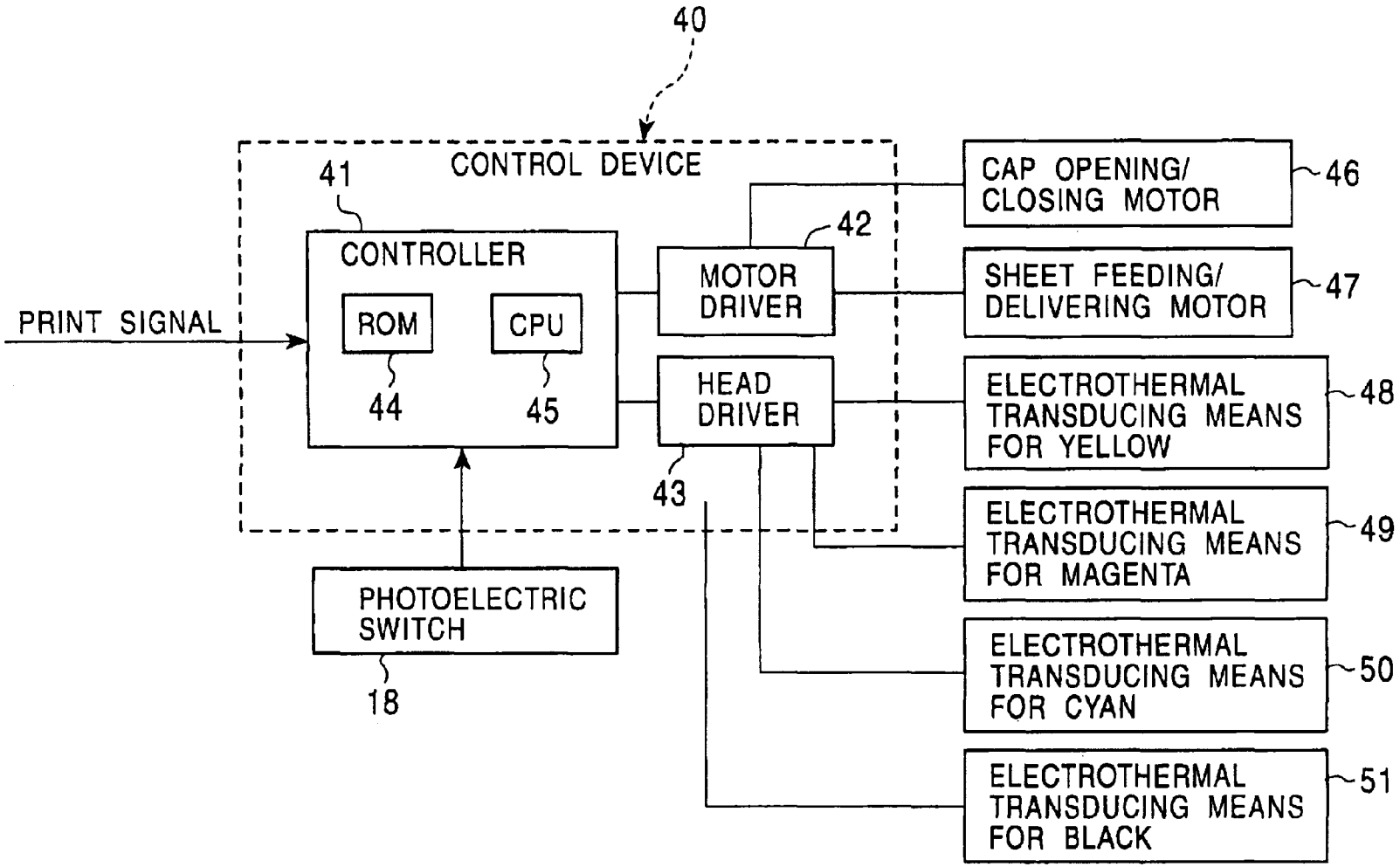
FIG. 9 is a block diagram illustrating the configuration and an operation of a controller for controlling the image forming apparatus.

FIG. 9 is a block diagram illustrating the configuration and an operation of a control device 40 for controlling the image forming apparatus having the above-described structure. The control device 40 is intended to control the drive of the moving means for moving the head cap 5 having the cleaning roller 7 housed therein and to control an discharge operation of ink from the ink-discharge openings of the print head 4, and is formed by a controller 41, a motor driver 42, and a head driver 43.

The controller 41 serves as drive control means for controlling the drive of a cap opening/closing motor 46, which will be described later, for opening and closing the head cap 5 and also as discharge control means for controlling a discharge operation of ink from the ink-discharge openings; has a read only memory (ROM) 44 and a central processing unit (CPU) 45 therein, respectively, for storing a variety of information and control programs and for sending a variety of control commands in accordance with the control programs read out from the ROM 44; and controls the motor driver 42 and the head driver 43, which will be described later.

The motor driver 42 is intended to drive the cap opening/closing motor 46 for opening and closing the head cap 5 and a sheet feeding/delivering motor 47 for feeding and delivering a sheet of paper as a recording medium. The cap opening/closing motor 46 serves as moving means for moving the circumferential surface of the cleaning roller 7 and the ink-discharge surfaces 6 of the print head 4 relative to each other while keeping the former surface in contact with the latter surfaces.

The head driver 43 is intended to drive elements for discharging ink from the ink-discharge openings formed in the ink-discharge surfaces 6 of the print head 4 and sends a drive signal to each of electrothermal transducing means 48 for yellow, electrothermal transducing means 49 for magenta, electrothermal transducing means 50 for cyan, and electrothermal transducing means 51 for black, each made from an exothermic body, for example.

The control device 40 having the above-described configuration controls the controller 41 so as to take in a print signal indicating the start of an image forming operation from outside; to receive detecting signals representing the positions of the position-detecting sheets 17 corresponding to the ink-discharge surfaces 6 for the respective colors, from the photoelectric switch 18 shown in FIG. 7; and to send drive signals to the motor driver 42 and the head driver 43 so that yellow ink, magenta ink, cyan ink, and black ink are preliminarily discharged in the head cap 5 in that order in accordance with the order of the rows, over which the cleaning roller 7 passes, of the ink-discharge openings for the respective colors formed in the ink-discharge surfaces 6.

Figure 10:
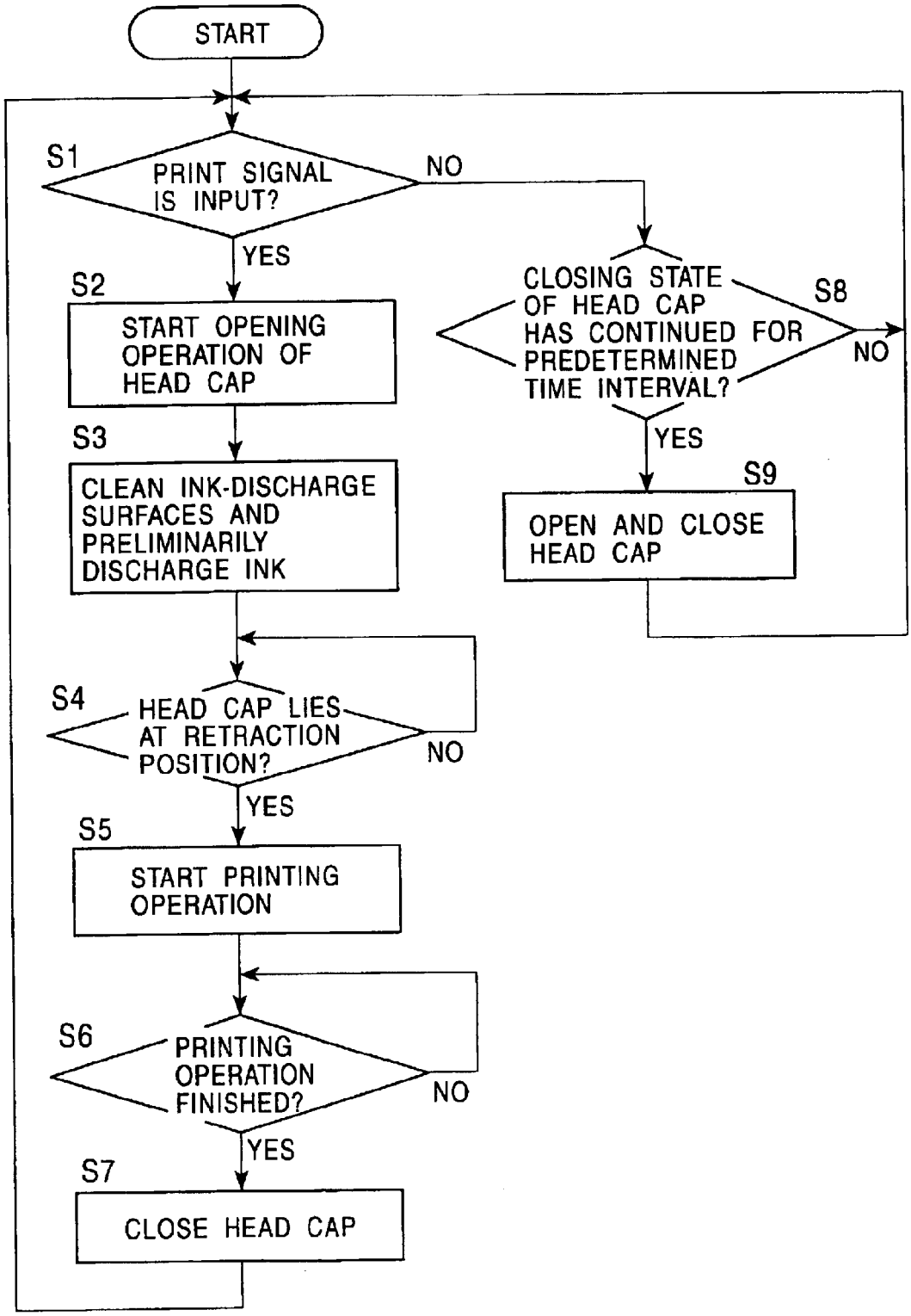
FIG. 10 is a flowchart of a control method of an image forming apparatus according to the present invention, wherein control for its printing operation is mainly illustrated.

FIG. 10 is a flowchart of a control method of an image forming apparatus having the above-described structure, wherein control for its printing operation is mainly illustrated. This control is performed at the directions of the CPU 45 in accordance with the control program stored in the ROM 44 in the controller 41 shown in FIG. 9.

First, in Step S1 shown in FIG. 10, when a print signal, indicating the start of an image forming operation is input into the controller 41 shown in FIG. 9, the controller 41 sends a cap-opening trigger signal to the motor driver 42 so as to drive the cap opening/closing motor 46, which hence starts an opening operation of the head cap 5 in Step S2. Next, in Step S3, the cleaning roller 7 cleans the ink-discharge surfaces 6 in concert with the opening operation of the head cap 5, and the controller 41 sends a preliminary discharge signal to the head driver 43 so as to preliminarily discharge ink.

Subsequently, when it is confirmed that the head cap 5 has reached its retraction position in Step S4, the printing operation starts in Step S5. Then, after the printing operation has been performed in Step S6, the controller 41 sends a cap-closing trigger signal to the motor driver 42 so as to drive the cap opening/closing motor 46, which hence closes the head cap 5 in Step S7. Then, the process returns to Step S1. Subsequently, the above operation is repeated in response to receipt of a print signal. Meanwhile, although the head cap 5 is closed immediately after the printing operation has been performed in the above description, the present invention is not limited to the above-mentioned operation; alternatively, the head cap 5 may be closed after a lapse of a predetermined time interval after the printing operation.

When the print signal has not been input in Step S1, the process advances to Step S8, and it is determined whether the closing state of the head cap 5 has continued for a predetermined time interval. When the closing state of the head cap 5 has continued for the predetermined time interval, the process advances to the "YES" side; in Step S9, the head cap 5 is opened and closed so as to clean the ink-discharge surfaces 6 and to preliminarily discharge ink; and the process returns to Step S1. Unless the closing state of the head cap 5 has continued for the predetermined time interval, the process advances to the "NO" side and returns to Step S1.

Referring next to FIGS. 11A to 11H, a sequential cleaning operation of the cleaning roller 7 and the head cap 5 of the image forming apparatus having the above-described structure will be described. Here, it is assumed that, in the inkjet head 1 shown in FIG. 2, the head cap 5 moves in the direction of the arrow A so as to clean the ink-discharge surfaces 6 of the print head 4, and after this cleaning operation, the preliminary discharge of ink is performed.

Figure 11A:
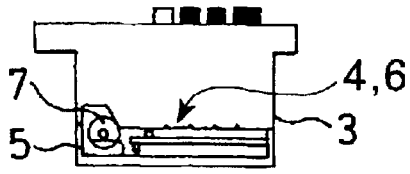
FIGS. 11A to 11H illustrate a cleaning operation of the head cap of the inkjet head and the cleaning roller.
Figure 11B:
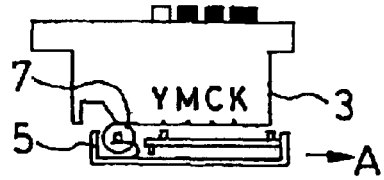
Figure 11C:
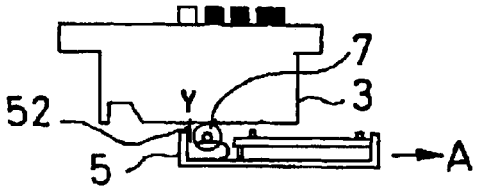

FIG. 11A illustrates an initial state in which the head cap 5 is closed relative to the ink cartridge 3. In this state and in the state shown in FIG. 1, the inkjet head 1 is inserted and set in the main body 2 of the printer. Then, while being set in the main body 2 of the printer, as shown in FIG. 11B, the head cap 5 moves in the direction of the arrow A relative to the ink cartridge 3 in response to a head-cap opening signal. With this movement, the cleaning roller 7 moves together with the head cap 5 in the direction of the arrow A relative to the ink cartridge 3 and rolls while being pressed and kept in contact with the ink-discharge surfaces 6 of the print head 4; or the cleaning roller 7 moves while its rotation being limited by fixing or by a brake mechanism or while being driven to rotate by a motor in the normal or reverse direction.

In this state, it is assumed that, in the state shown in FIG. 2, of the ink-discharge surfaces 6 of the print head 4, the ink-discharge surfaces 6 for yellow Y have been cleaned. With this cleaning, the position-detecting sheet 17 disposed on lower surface side of the head cap 5 and corresponding to yellow Y (see FIG. 7) moves to the detecting position of the photoelectric switch 18, thereby detecting the fact-that the ink-discharge surfaces 6 for yellow Y have been cleaned.

With the above mentioned operation, a preliminary-discharge start signal is sent from the controller 41 to the head driver 43, both shown in FIG. 9. That is, the preliminary-discharge start signal is sent to the row of the ink-discharge openings of the ink-discharge surfaces 6 for yellow Y (i.e., to the electrothermal transducing means 48 for yellow).

Next, as shown in FIG. 1C, preliminary discharge ink 52 is jetted from the ink-discharge openings of the ink-discharge surfaces 6 for yellow Y. Then, a preliminary-discharge stop signal is sent to the ink-discharge openings of the ink-discharge surfaces 6 for yellow Y so as to stop the jetting of the preliminary discharge ink 52. Subsequently, in a similar fashion to the above-mentioned manner, every time the cleaning roller 7 sequentially has cleaned each of the rows of the ink-discharge surfaces 6 for the colors M, C, and K in the state shown in FIG. 2, the photoelectric switch 18 detects the fact that the corresponding ink-discharge surfaces 6 have been cleaned, and on the basis of this detection, a preliminary-discharge start signal and then a preliminary-discharge stop signal are sent from the controller 41 to the corresponding row of the ink-discharge openings.

Figure 11D:
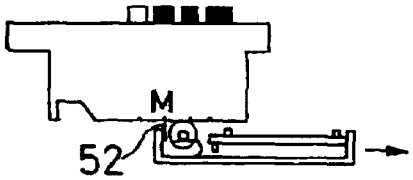
Figure 11E:
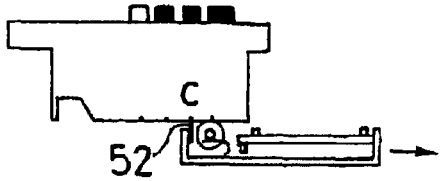
Figure 11F:
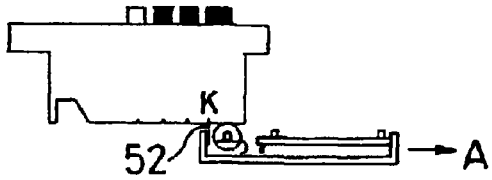

With the above-mentioned operation, as shown in FIGS. 11D to 11F, the timing of the preliminary discharge from each of the rows of the ink-discharge openings for the respective colors is controlled and the preliminary discharge ink 52 is sequentially jetted in the order of the colors M, C, and K.

Upon the cleaning of the ink-discharge surfaces 6 for the respective colors and the preliminary discharge of ink as described above, as shown in FIG. 11G, the head cap 5 moves to its limit in the direction of the arrow A, then moves slightly upwards, and lies at the retraction position. In this state, characters and/or pictures are printed on a recording sheet.

Figure 11G:
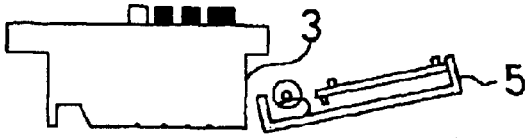
Figure 11H:
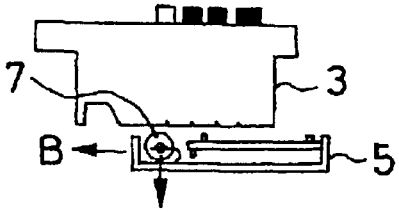

Next, when characters and/or pictures have been printed on recording sheets with the required number of pages, a head cap closing signal is sent and the head cap 5 hence moves from the above-mentioned retraction position in the direction of the arrow B relative to the ink cartridge 3, as shown in FIG. 11H. With this movement, the cleaning roller 7 moves together with the head cap 5 in the direction of the arrow B relative to the ink cartridge 3; eventually becomes into the closed state and returns to the initial state.

Meanwhile, while the cleaning roller 7 is returning in the direction of the arrow B, the cleaning roller 7 does not come into contact with the ink-discharge surfaces 6; hence the ink-discharge surfaces 6 are not cleaned. Subsequent to that, the image forming apparatus waits for a next direction of a printing operation of characters and/or pictures.

In the operation illustrated in FIGS. 11A to 11H, when the head cap 5 moves in the direction of the arrow A, the cleaning roller 7 comes into contact with the ink-discharge surfaces 6 and cleans them, and when the head cap 5 returns in the direction of the arrow B, the cleaning roller 7 does not come into contact with the ink-discharge surfaces 6. However, the present invention is not limited to this arrangement; and the head cap 5 may move in the directions of the arrows A and B with the cleaning roller 7 not coming into contact with the ink-discharge surfaces 6.

In this case, the cleaning roller 7 does not clean the ink-discharge surfaces 6, and the only thing to do is preliminarily discharge ink toward inside the head cap 5. This operational sequence may be arranged such that the preliminary discharge of ink is performed when the head cap 5 returns from the retraction position shown in FIG. 11G to the position shown in FIG. 11G, and then the head cap 5 moves again to the retraction position shown in FIG. 11G.

Alternatively, with the head cap 5 lying at the retraction position shown in FIG. 11G, ink may be preliminarily discharged regardless of the opening/closing operation of the head cap 5, that is, without cleaning the ink-discharge surfaces 6 by the cleaning roller 7.

In the description referring to FIGS. 10 and 11A to 11G, the cleaning operation is performed such that the ink-discharge surfaces 6 are cleaned when the head cap 5 moves in the direction of the arrow A and is then opened, and the preliminary discharge of ink is performed after this cleaning operation. On the contrary, the cleaning operation may be performed such that the head cap 5 moves in the direction of the arrow A and is then opened without cleaning the ink-discharge surfaces 6; then, the ink-discharge surfaces 6 are cleaned by the cleaning roller 7 when the head cap 5 moves in the direction of the arrow B and is then closed; and the preliminary discharge of ink is performed after this cleaning operation.

Figure 12:
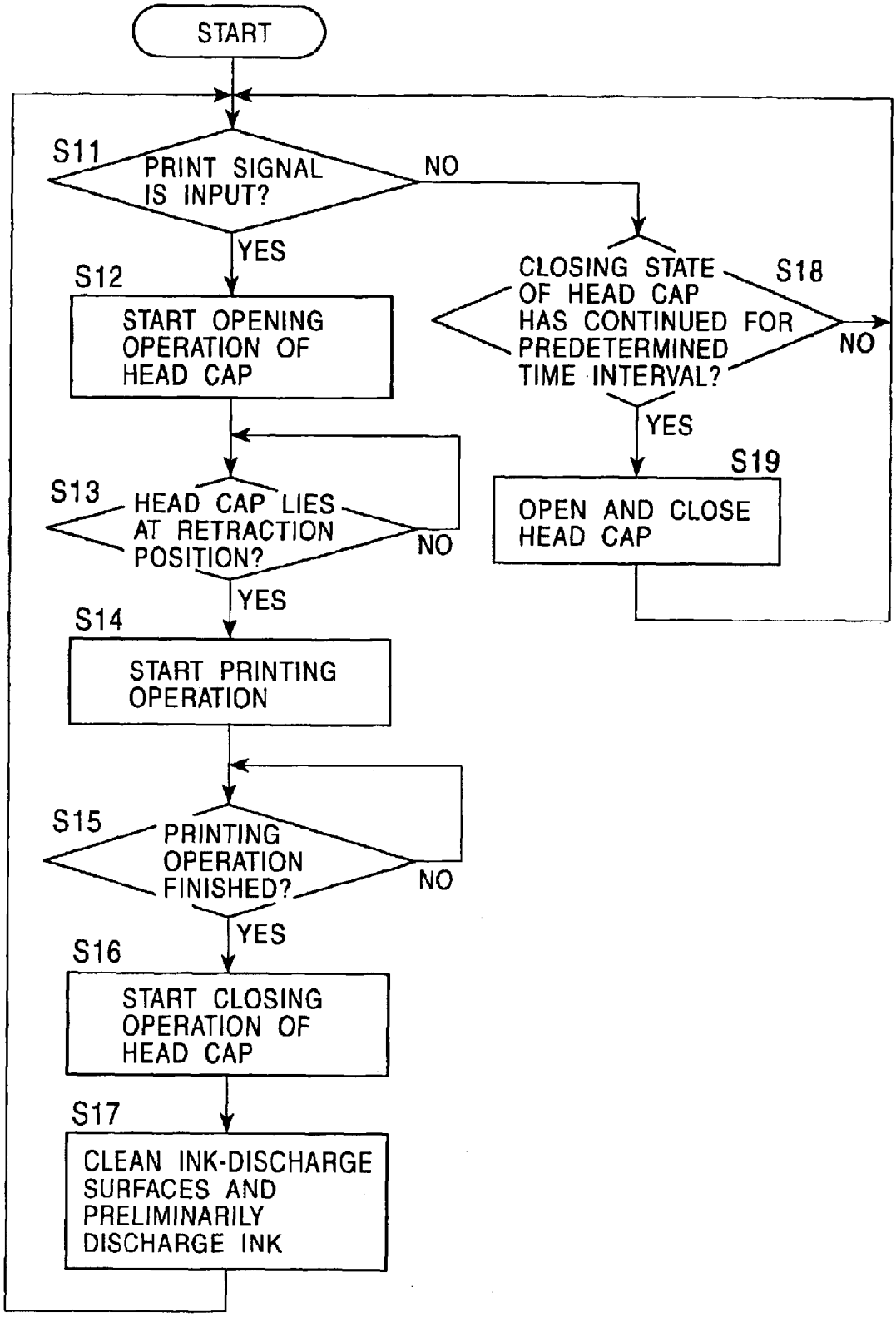
FIG. 12 is a flowchart of another control method of an image forming apparatus according to the present invention, wherein control for its printing operation is mainly illustrated.

FIG. 12 is a flowchart of an operation of the image forming apparatus and a control method thereof in the case where the ink-discharge surfaces 6 are cleaned by the cleaning roller 7 when the above-mentioned head cap 5 moves in the direction of the arrow B after being opened and is then closed; and the preliminary discharge of ink is performed after this cleaning operation, wherein control for its printing operation is mainly illustrated. This control is performed at the directions of the CPU 45 in accordance with the control program stored in the ROM 44 in the controller 41 shown in FIG. 9.

First, in Step S11 shown in FIG. 12, when a print signal indicating the start of an image forming operation is input into the controller 41 shown in FIG. 9, the controller 41 sends a cap-opening trigger signal to the motor driver 42 so as to drive the cap opening/closing motor 46, which hence starts an opening operation of the head cap 5 in Step S12. Next, when it is confirmed that the head cap 5 has reached its retraction position in Step S13, the printing operation starts in Step S14.

When the printing operation has been performed in Step S15, the controller 41 sends a cap-closing trigger signal to the motor driver 42 so as to drive the cap opening/closing motor 46, which hence starts a closing operation of the head cap 5 in Step S16. Next, in Step S17, the cleaning roller 7 cleans the ink-discharge surfaces 6 in concert with the closing operation of the head cap 5, and the controller 41 sends a preliminary discharge signal to the head driver 43 so as to preliminarily discharge ink. Then, the process returns to Step S11.

Subsequently, the above operation is repeated in response to receipt of a print signal. Meanwhile, although the head cap 5 is closed immediately after the printing operation in the above description, the present invention is not limited to this arrangement; alternatively, the head cap 5 may be closed after a lapse of a predetermined time interval after the printing operation.

Unless the print signal has been input in Step S1, the process advances to Step S18, and it is determined whether the closing state of the head cap 5 has continued for the predetermined time interval. When the closing state of the head cap 5 has continued for the predetermined time interval, the process advances to the "YES" side; in Step S19, the head cap 5 is opened and closed so as to clean the ink-discharge surfaces 6 and to preliminarily discharge ink; and the process returns to Step S11. Unless the closing state of the head cap 5 has continued for the predetermined time interval, the process advances to the "NO" side and returns to Step S11.

Figure 13A:
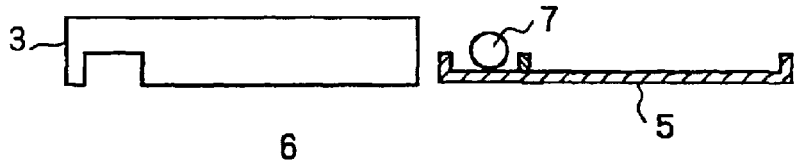
FIGS. 13A to 13C illustrate another cleaning operation of the head cap of the inkjet head and the cleaning roller.
Figure 13B:
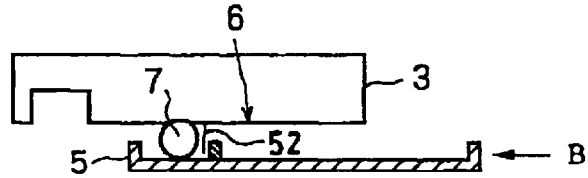
Figure 13C:
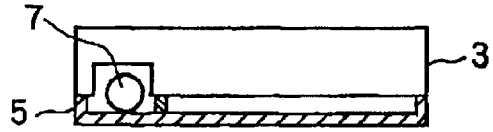

FIGS. 13A to 13C illustrate a sequential operation of the head cap 5 and the cleaning roller 7 in the case where the ink-discharge surfaces 6 are cleaned by the cleaning roller 7 when the above-mentioned head cap 5 moves in the direction of the arrow B after being opened and is then closed, and the preliminary discharge of ink is performed after this cleaning operation. Here, an operation after the printing operation of characters and/or pictures has been performed in the state shown in FIG. 11G will be described.

As shown in FIG. 13A, when characters and/or pictures have been printed on recording sheets with the required number of pages with the head cap 5 lying at the retraction position, a head cap closing signal is sent and the head cap moves from the above-mentioned retraction position in the direction of the arrow B relative to the ink cartridge 3, as shown in FIG. 13B.

In accordance with the closing operation of the head cap 5, the circumferential surface of the cleaning roller 7 comes into contact with the ink-discharge surfaces 6 of the print head 4 so as to clean the ink-discharge surfaces 6 in the order of the colors K, C, M, and Y in the opposite direction to that of the opening operation of the head cap 5. Then, when the photoelectric switch (not shown) detects the passing of one of the position-detecting sheets (not shown) which corresponds to the ink-discharge surfaces 6 for the corresponding color, the preliminary discharge ink 52 for the corresponding color is jetted. Thus, when the ink-discharge surfaces 6 are cleaned and four kinds of ink for all four colors are preliminarily discharged, the process returns to the initial state shown in FIG. 13C.

As described above, according to the operation and the control method illustrated in FIGS. 12 and 13A to 13C, when the head cap 5 is closed, the cleaning roller 7 is moved on the ink-discharge surfaces 6 so as to cause ink in the ink-discharge openings to be sucked, whereby the ink-discharge openings and the vicinities thereof are effectively cleaned without damaging the ink-discharge surfaces 6.

Referring now to FIGS. 1 and 14 to 20, the entire structure and an operation of the above-described image forming apparatus, taking an inkjet printer for example, will be described. This inkjet printer is intended to finely particulate ink and to discharge it from an ink-jet head so as to form ink dots on a recording sheet, and as shown in FIG. 1, has the inkjet head 1, the main body 2 of the printer, a head mounting/demounting mechanism 19, and a head-cap opening/closing mechanism 20. Meanwhile, the inkjet printer is of a type in which the inkjet head 1 is directly mounted in the main body 2 of the printer.

The inkjet head 1 is intended to finely particularize liquid ink by, for example, an electrothermal transducing method or an electromechanical transducing method and discharges it so as to form ink dots on a recording sheet, and has the same structure as that described with reference to FIGS. 1 to 13C.

The main body 2 of the printer is intended to have the inkjet head 1 mounted at a predetermined portion thereof so as to perform functions required for an inkjet printer and is equipped with a recording-sheet tray, a transport system for a recording sheet, an operational drive system, a control circuit for the overall image forming apparatus, and so forth. Meanwhile, the reference numeral 21 shown in FIG. 1 represents a sheet-feed cartridge for feeding a recording sheet and a discharged-sheet receiver into which a printed sheet is discharged.

The head mounting/demounting mechanism 19 is intended to mount and fix the inkjet head 1 at the predetermined portion of the main body 2 of the printer and to release the fixing. For example, the head mounting/demounting mechanism 19 is formed by a horizontally oriented bar member having a structure so as to insert the inkjet head 1 into the predetermined recessed portion disposed at the central part of the main body 2 of the printer and to press the upper surface of the inkjet head 1.

More particularly, the bar member extends through the overall width of the main body 2 of the printer and is arranged so as to erect vertically and fall down horizontally. Thus, the bar member allows the inkjet head 1 to be inserted in the direction of the arrow H and to be mounted in the main body 2 of the printer while erecting vertically as shown in FIG. 1 and fixes the inkjet head 1 at the predetermined portion while falling down horizontally as shown in FIG. 14.

The head-cap opening/closing mechanism 20 is intended to move the head cap 5 relative to the print head 4 with the inkjet head 1 being fixed at the predetermined portion of the main body 2 of the printer (see FIG. 2) so as to expose the ink-discharge surfaces 6 (see FIG. 2) and also to close the head cap 5 after an printing operation and is formed by an engaging combination of a rack 22 and a pinion 23 disposed, for example, on one of the side surfaces of the main body 2 of the printer. Meanwhile, the rack 22 has a pin-shaped projection formed on the inner side surface thereof, which is fitted into a depression formed in the corresponding outer side surface of the head cap 5.

Figure 14:
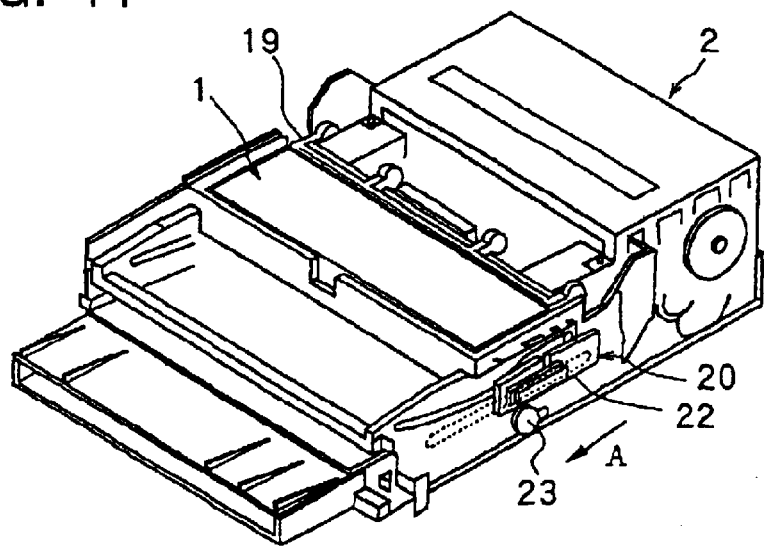
FIG. 14 is a perspective view of the image forming apparatus, taking an inkjet printer for example, according to the embodiment of the present invention, illustrating a state in which the inkjet head is mounted therein.
Figure 15:
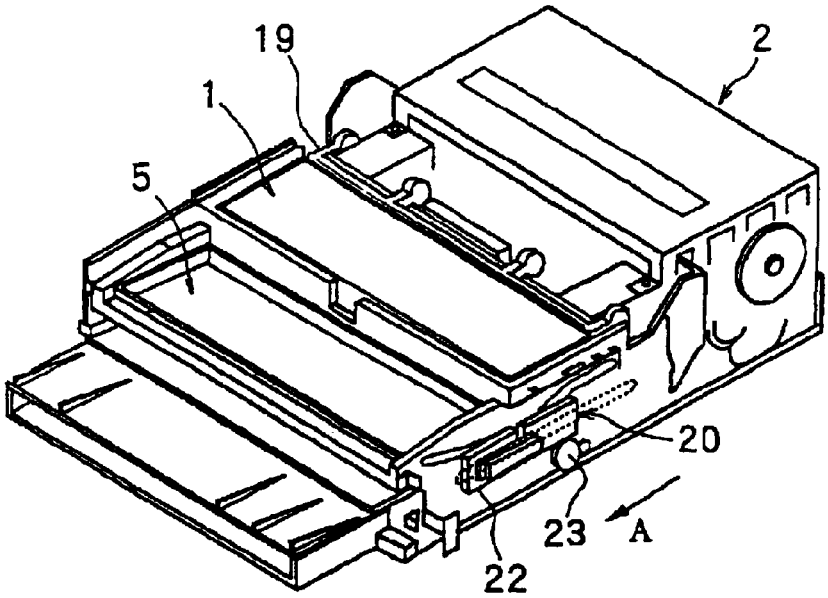
FIG. 15 is a perspective view of the inkjet printer according to the embodiment, illustrating a state in which the head cap is opened.

Thus, as shown in FIG. 14, with the inkjet head 1 being fixed at the predetermined portion of the main body 2 of the printer by the head mounting/demounting mechanism 19, when the pinion 23 is rotated in a predetermined direction by a motor (not shown), the rack 22 moves in the direction of the arrow A as shown in FIG. 15, thereby causing the head cap 5 shown in FIG. 1 to move in the direction of the arrow A, and to be opened and eventually lie at the retraction position.

Meanwhile, the head-cap opening/closing mechanism 20 is not limited to the above-mentioned engaging combination of the rack 22 and the pinion 23, and it may have an example structure in which rubber rollers are pressed against on both side surfaces of the head cap 5; the rotating shafts of the rubber rollers are coupled with the motor; and the motor is rotated so that the friction with the rubber rollers causes the head cap 5 to move in the direction of the arrow A and to be opened.

Referring next to FIGS. 16 to 20, a specific mechanism and operation for fixing the inkjet head 1 at the predetermined portion of the main body 2 of the printer shown in FIG. 1 and for moving the head cap 5 relative to the print head 4 (see FIG. 2) so as to expose the ink-discharge surfaces 6 (see FIG. 2).

Figure 16:
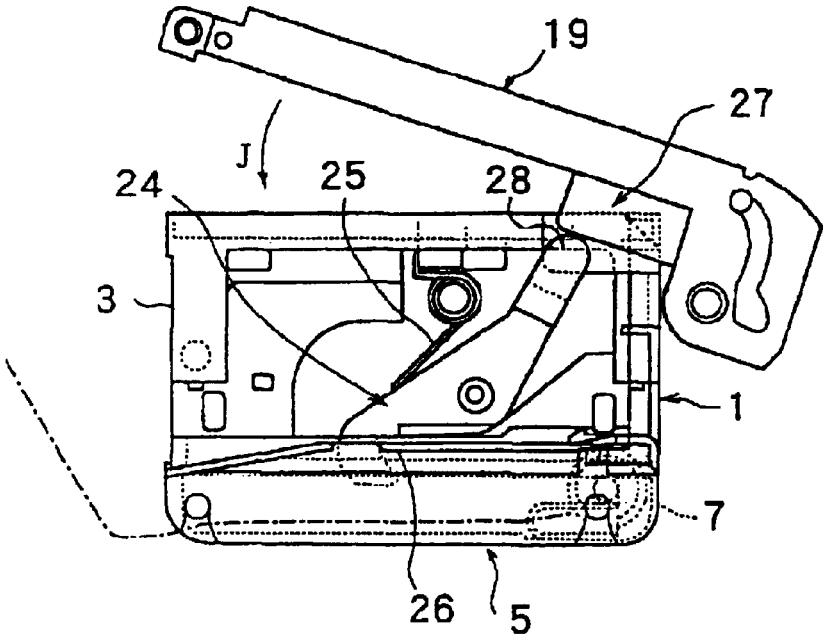
FIG. 16 shows a specific mechanical structure and operation of the inkjet printer, illustrating a state in which, in the state shown in FIG. 1, the inkjet head is inserted in the direction of the arrow H and is disposed at a predetermined portion of a main body of the printer.

FIG. 16 shows a state in which, in the state shown in FIG. 1, the inkjet head 1 is inserted in the direction of the arrow H and is disposed at the predetermined portion of the main body 2 of the printer. In this state, the elastic force of a helical spring 25 causes the bottom ends of cap-lock hooks 24 disposed in the inkjet head 1 and at both side ends thereof so as to engage with retaining pieces 26 formed on both sides of the head cap 5. With this structure, the head cap 5 is integrally mounted on the ink cartridge 3.

Figure 17:
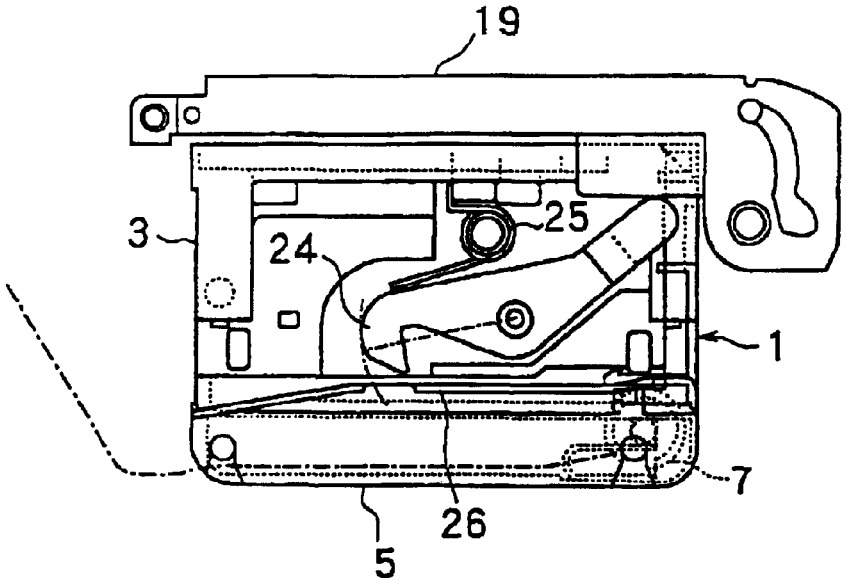
FIG. 17 shows the specific mechanical structure and operation of the inkjet printer, illustrating a state in which the inkjet head is fixed to the predetermined portion of the main body of the printer by a head mounting/demounting mechanism and the head cap is movable.

In this state and in the state shown in FIG. 16, the head mounting/demounting mechanism 19 is pressed down in the direction of the arrow J indicated in the drawing and is fixed. With this movement, top ends 28 of the cap-lock hooks 24 are pressed down and turned by a cap-lock releasing piece 27 disposed at the lower portion of the head mounting/demounting mechanism 19; thus, as shown in FIG. 17, the bottom ends of the cap-lock hooks 24 are raised; as a result, the bottom ends of the cap-lock hooks 24 are disengaged with the retaining pieces 26 disposed on both sides of the head cap 5. With this arrangement, as shown in FIG. 14, the inkjet head 1 is fixed to the predetermined portion of the main body 2 of the printer by the head mounting/demounting mechanism 19 and also the head cap 5 becomes movable.

Figure 18:
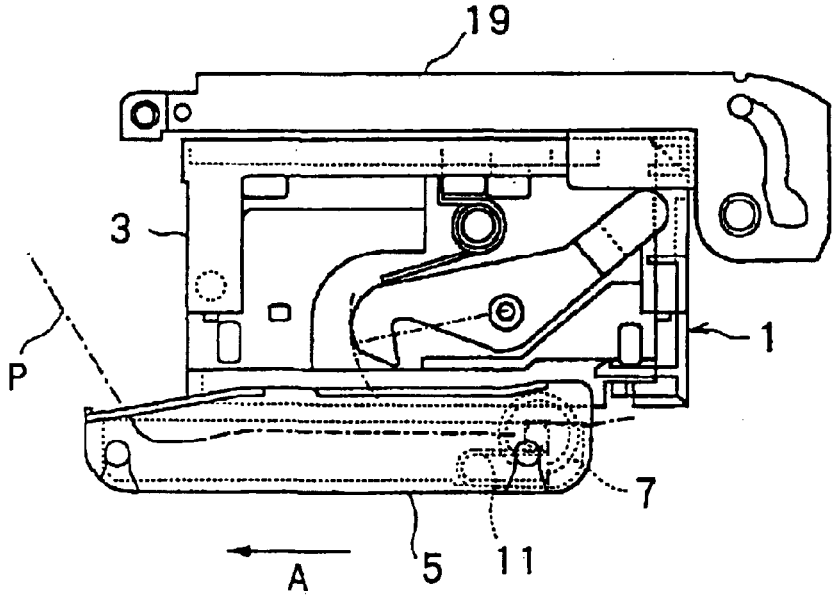
FIG. 18 shows the specific mechanical structure and operation of the inkjet printer, illustrating a state in which the head cap mounted on the bottom side of an ink cartridge moves in the direction of the arrow A and is then opened.

Next, when the head-cap opening/closing mechanism 20 shown in FIG. 14 is activated and the pinion 23 is rotated by the motor (not shown), the rack 22 moves in the direction of the arrow A. With this movement, as shown in FIG. 18, the head cap 5 mounted on the bottom side of the ink cartridge 3 moves together with the rack 22 in the direction of the arrow A and is then opened. Then, the cleaning roller 7 urged by the floating springs 11 starts to clean the ink-discharge surfaces 6 of the print head 4 disposed on the bottom surface of the ink cartridge 3 as shown in FIG. 2. Meanwhile, the head cap 5 moves while following a moving trajectory P shown in FIG. 18.

Figure 19:
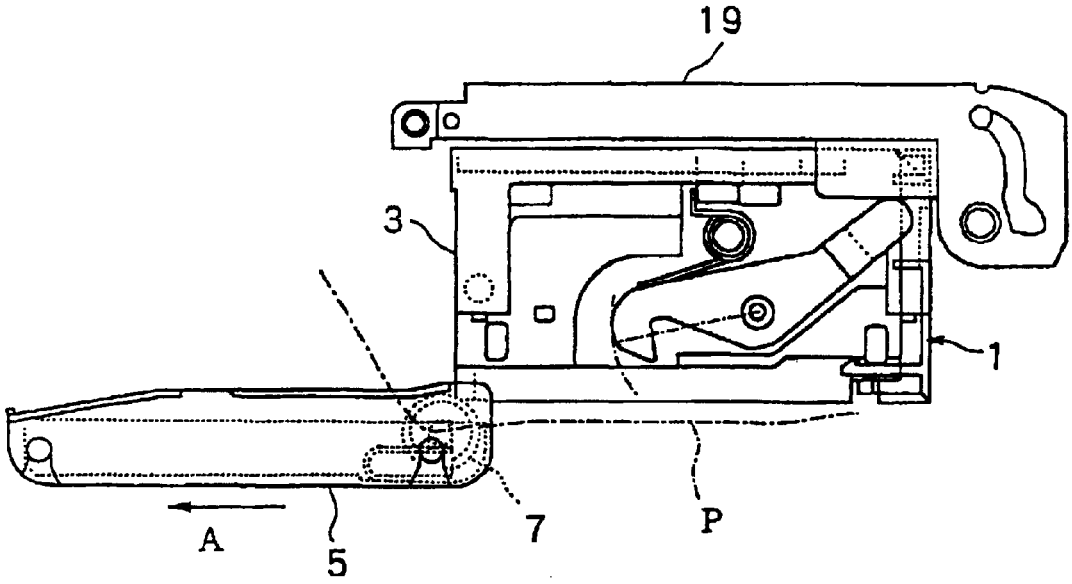
FIG. 19 shows the specific mechanical structure and operation of the inkjet printer, illustrating a state in which the head cap moves successively in the direction of the arrow A while following a moving trajectory P indicated in the drawing.

Then, as shown in FIG. 19, the head cap 5 moves successively while following the moving trajectory P in the direction of the arrow A. In this state, the ink-discharge surfaces 6 for the respective colors Y, M, C, and K shown in FIG. 2 are successively cleaned by the cleaning roller 7 fixed to the head cap 5, and after this cleaning operation, the preliminary discharge of ink is performed.

Figure 20:
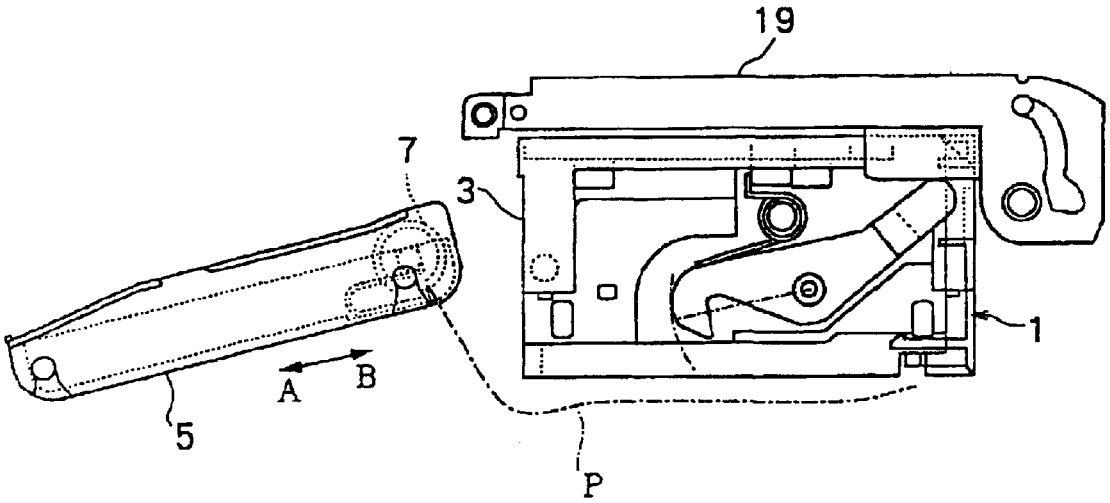
FIG. 20 shows the specific mechanical structure and operation of the inkjet printer, illustrating a state in which the head cap lies at its retraction position upon moving to its limit in the direction of the arrow A while following the moving trajectory P.

When the cleaning of the ink-discharge surfaces 6 for the respective colors and the preliminary discharge of ink have been performed, as shown in FIG. 20, the head cap 5 moves to its limit in the direction of the arrow A while following the moving trajectory P; then moves slightly upwards; and lies at the retraction position as shown in FIG. 15. In this state, characters and/or pictures are printed on a recording sheet. With this structure, since the head cap 5 moves slightly upwards as shown in FIG. 20, a space for storing the head cap 5 can be reduced.

Although a recording sheet passes below the print head 4 disposed on the bottom surface of the ink cartridge 3 in the state shown in FIG. 20, the recording sheet may be guided to pass by the lower surface of the head cap 5. In such a case, a rib or ribs for guiding the recording sheet may be disposed on the lower surface side of the head cap 5. In addition, the lower surface of the head cap 5 may be treated with water repellent finish in order to prevent ink printed on the recording sheet from accreting on the lower surface.

When characters and/or pictures have been printed on recording sheets with the required number of pages in this state, the head cap 5 moves from the retraction position shown in FIG. 20 in the direction of the arrow B in reverse order to the above-mentioned order, and as shown in FIG. 17, the head cap 5 returns to the initial state where it lies below the bottom surface of the ink cartridge 3.

In the state shown in FIG. 16, when the head mounting/demounting mechanism 19 is opened in the opposite direction to the arrow J indicated in the drawing, the cap-lock hooks 24 are engaged with the retaining pieces 26 disposed on both sides of the head cap 5 by the elastic force of the helical spring 25, whereby the head cap 5 is integrally mounted on the ink cartridge 3. In this state, as shown in FIG. 1, the inkjet head 1 can be removed from the main body 2 of the printer.

When the power of the printer is shut off caused by a trouble of some kind with the head cap 5 lying at the retraction position shown in FIG. 20, the head cap 5 remains lying at the retraction position. In this state, when the head mounting/demounting mechanism 19 is opened in the opposite direction to the arrow J as shown in FIG. 16, only the ink cartridge 3 is removed with the head cap 5 remaining at the retraction position.

In order to prevent the above problem, an interlock mechanism may be constructed such that the head cap 5 lying at the retraction position returns automatically to the initial state shown in FIG. 16 when the power of the printer is shut off caused by a problem of some kind, or the head mounting/demounting mechanism 19 is allowed to open in the opposite direction to the arrow J only when the head cap 5 lies in the initial state shown in FIG. 16.

Figure 21A:
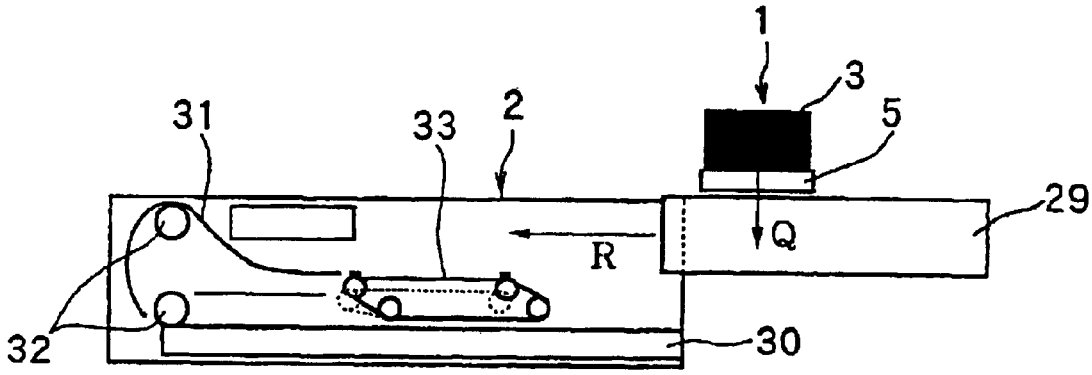
FIGS. 21A and 21B schematically illustrate an ink-jet printer of another type in which the inkjet head is mounted in the main body of the printer via a tray.
Figure 21B:
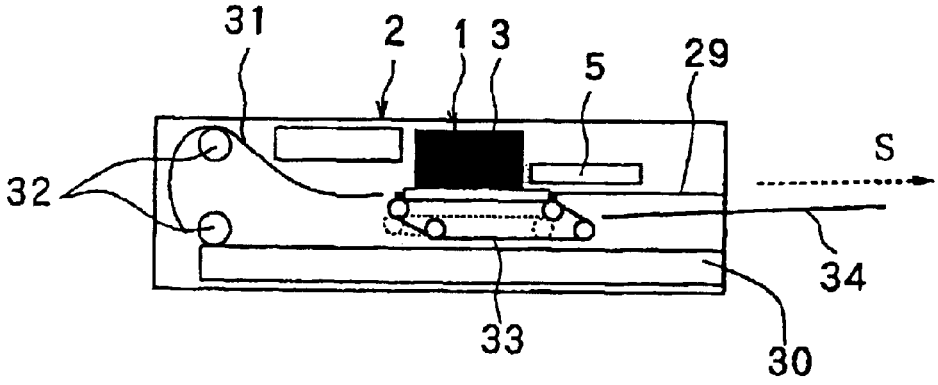

Although the inkjet printer as described with reference to FIGS. 1 and 14 to 20 is of a type in which the ink-jet head 1 is directly mounted in the main body 2 of the printer, the present invention is not limited to the above mentioned type, and is likewise applicable to a type in which the inkjet head 1 is mounted in the main body 2 of the printer via a tray. Referring now to FIGS. 21A and 21B, an ink-jet printer of another type will be briefly described.

First, as shown in FIG. 21A, the inkjet head 1 having the head cap 5 integrally mounted on the ink cartridge 3 is mounted, in a manner shown by the arrow Q indicated in the drawing, at a predetermined location in a tray 29 which can move forward and backward relative to the main body 2 of the printer. Then, the tray 29 is moved in the direction of the arrow R and is set in the main body 2 of the printer.

In this state, as shown in FIG. 21B, the head cap 5 is retained halfway while the tray 29 is moving in the direction of the arrow R by appropriate retaining means disposed in the main body 2 of the printer and is brought to a halt. The tray 29 is intended to set the inkjet head 1 in the main body 2 of the printer and to replace it with another one.

Then, since the tray 29 moves further in the direction of the arrow R, the ink cartridge 3 moves in the direction of the arrow R relative to the head cap 5; as a result, the head cap 5 is opened. At the same time, when the head cap 5 moves in the opposite direction to the arrow R relative to the ink cartridge 3, the ink-discharge surfaces 6 of the print head 4 are cleaned and also the preliminary discharge of ink is performed in accordance with the same operation as shown in FIGS. 11A to 11H. After then, characters and/or pictures are printed on a recording sheet.

Meanwhile, FIGS. 21A and 21B show a recording-sheet tray 30, a recording sheet 31, feeding rollers 32, a feeding belt 33, a sheet-discharging tray 34, and a discharge direction S of a recording sheet.

When characters and/or pictures have been printed, the ink cartridge 3 moves in the opposite direction to the arrow R relative to the head cap 5 and returns to the initial state in which the head cap 5 is closed. In this case, when the ink cartridge 3 returns in the direction so as to close the head cap 5 relative to the ink cartridge 3, the ink-discharge surfaces 6 of the print head 4 are not cleaned and the preliminary discharge is not performed.

Meanwhile, in the case of the operation shown in FIGS. 12, 13A, and 13B, from the state in which the head cap 5 shown in FIG. 21B is opened, when the ink cartridge 3 moves in the opposite direction to the arrow R relative to the head cap 5 and the head cap 5 is closed, the ink-discharge surfaces 6 of the print head 4 are cleaned, and after this cleaning operation, the preliminary discharge of ink is performed.

Although an inkjet printer of a line scan head type has been described as an example of the image forming apparatus, the present invention is not limited to the above-described printer and is applicable to an inkjet printer of a serial type. Also, the present invention is not limited to ink-jet printers and is applicable to image forming apparatuses such as a facsimile machine and a copying machine of an ink-jet recording type.

What is claimed is:

1. An image forming apparatus for forming an image on a recording medium by discharging ink from ink-discharge openings, comprising: a print head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head; drive control means for controlling the moving means; a cap member for protecting the ink-discharge surfaces of the print head; and cap opening/closing means for opening and closing the cap member, wherein, when the cap member is opened by the cap opening/closing means, by driving the moving means with control of the drive control means so as to effect relative motion between the cleaning member and the print head while keeping the circumferential surface of the cleaning member in contact with the ink-discharge surfaces, ink in the ink-discharge openings is sucked.

2. The image forming apparatus according to claim 1, wherein the cap member is opened and closed when a closing state of the cap member has continued for a predetermined time interval.

3. The image forming apparatus according to claims 1, wherein the cap member is closed after an operation of forming an image on a recording sheet.

4. The image forming apparatus according to claim 1, wherein the cap member is closed unless an image forming operation is performed for a predetermined time interval after en operation of forming an image on a recording sheet.

5. An image forming apparatus for forming an image on a recording medium by discharging ink from ink-discharge openings, comprising: a sprint head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head; drive control means for controlling the moving means; discharge control means for controlling a discharge operation of ink from the ink-discharge openings formed in the discharge surfaces; a cap member for protecting the ink-discharge surfaces of the print head; and cap opening/closing means for opening and closing the cap member, wherein, when the cap member is opened by the cap opening/closing means, by driving the moving means with control of the drive control means so as to effect relative motion between the cleaning member and the print head while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

6. The image forming apparatus according to claim 5, wherein an ink receiver for receiving ink preliminarily discharged from the ink-discharge openings is provided in the cap member.

7. An image forming apparatus for forming an image on a recording medium by discharging ink from ink-discharge opening, comprising: a print head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head; drive control means for controlling the moving means; discharge control means for controlling a discharge operation of ink from the ink-discharge openings formed in the discharge surfaces; a cap member for protecting the ink-discharge surfaces of the print head; and cap opening/closing means for opening and closing the cap member, wherein, when the cap member is opened by the cap opening/closing means, by performing a discharge operation of ink from the ink-discharge openings with control of the discharge control means, ink is preliminarily discharged from the ink-discharge openings.

8. An image forming apparatus for forming an image on a recording medium by discharging ink from ink-discharge openings, comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the opening operation of the cap member while keeping the circumferential surface of the cleaning member in contact with the ink-discharge surfaces of the print head; and drive control means for controlling the cap opening/closing means, wherein, when the cap member is opened by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked.

9. An image forming apparatus for forming an image on a recording medium by discharging ink from ink-discharge openings, comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the opening operation of the cap member while keeping the circumferential surface of the cleaning member in contact with the ink-discharge surfaces of the print head; drive control means for controlling the cap opening/closing means; and discharge control means for controlling a discharge operation of ink from the ink-discharge openings formed in the discharge surfaces, wherein, when the cap member is opened by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

10. An image forming apparatus for forming an image on a recording medium by discharging ink from ink-discharge openings, comprising: a print head including ink-discharge surface having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the opening operation of the cap member while keeping the circumferential surface of the cleaning member in contact with the ink-discharge surfaces of the print head; drive control means for controlling the cap opening/closing means; and discharge control means for controlling a discharge operation of ink from the ink-discharge openings formed in the discharge surfaces, wherein, when the cap member is opened by the cap opening/closing means, by performing a discharge operation of ink from the ink-discharge openings with control of the discharge control means, ink is preliminarily discharged from the ink-discharge openings.

11. An image forming apparatus for forming an image on a recording medium by discharging ink from ink-discharge openings, comprising: a print head including ink-discharge surfaces having a plurality of rows of the ink-discharge openings formed therein for a corresponding plurality of colors; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in a direction orthogonal to the plurality of rows of the ink-discharge openings for the respective colors in accordance with the opening operation of the cap member while keeping the circumferential surface of the cleaning member in contact with the ink-discharge surfaces of the print head; drive control means for controlling the cap opening/closing means; and discharge control means for controlling a discharge operation of ink from the ink-discharge openings formed in the discharge surfaces, wherein, when the cap member is opened by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked, and in an order of the rows, over which the cleaning member passes with control of the discharge control means, of the ink-discharge openings for the corresponding colors formed in the ink-discharge surfaces, ink is preliminarily discharged from the ink-discharge openings with control of the discharge control means.

12. An image forming apparatus for forming an image on a recording medium by discharging ink from ink-discharge openings, comprising: a print head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head; drive control means for controlling the moving means; a cap member for protecting the ink-discharge surfaces of the print head; and cap opening/closing means for opening and closing the cap member, wherein, when the cap member is closed by the cap opening/closing means, by driving the moving means with control of the drive control means so as to effect relative motion between the cleaning member and the print head while keeping the circumferential surface of the cleaning member in contact with the ink-discharge surfaces, ink in the ink-discharge openings is sucked.

13. An image forming apparatus for forming an image on a recording medium by discharging ink from ink-discharge openings, comprising: a print head including ink -discharge surfaces having the ink-discharge openings formed therein; a cylindrical cleaning member composed of am elastic material; moving means for effecting relative motion between the cleaning member and the print head while keeping the circumferential surface of the cleaning member in contact with the ink-discharge surfaces of the print head; drive control means for controlling the moving means; discharge control means for controlling a discharge operation of ink from the ink-discharge openings formed in the discharge surfaces; a cap member for protecting the ink-discharge surfaces of the print head; and cap opening/closing means for opening and closing the cap member; wherein, when the cap member is closed by the cap opening/closing means, by driving the moving means with control of the drive control means so as to effect relative motion between the cleaning member and the print head while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

14. An image forming apparatus for forming an image on a recording medium by discharging ink from ink-discharge openings, comprising: a print head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head; drive control means for controlling the moving means; discharge control means for controlling a discharge operation of ink from the ink-discharge openings formed in the discharge surfaces; a cap member for protecting the ink-discharge surfaces of the print head; and cap opening/closing means for opening and closing the cap member, wherein, when the cap member is closed by the cap opening/closing means, by performing a discharge operation of ink from the ink-discharge openings with control of the discharge control means, ink is preliminarily discharged from the ink-discharge openings.

15. An image forming apparatus for forming an image on a recording medium by discharging ink from ink-discharge openings, comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the closing operation of the cap member while keeping the circumferential surface of the cleaning member in contact with the ink-discharge surfaces of the print head; and drive control means for controlling the cap opening/closing means, wherein, when the cap member is closed by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked.

16. An image forming apparatus for forming an image on a recording medium by discharging ink from ink-discharge openings, comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the closing operating of the cap member while keeping the circumferential surface of the cleaning member in contact with the ink-discharge surfaces of the print head; drive control means for controlling the cap opening/closing means; and discharge control means for controlling a discharge operation of ink from the ink-discharge openings formed in the discharge surfaces, wherein, when the cap member is closed by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

17. An image forming apparatus for forming an image on a recording medium by discharging ink from ink-discharge openings, comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the closing operation of the cap member while keeping the circumferential surface of the cleaning member in contact with the ink-discharge surfaces of the print head; drive control means for controlling the cap opening/closing means; and discharge control means for controlling a discharge operation of ink from the ink-discharge openings formed in the discharge surfaces, wherein, when the cap member is closed by the cap opening/closing means, by performing a discharge operation of ink from the ink-discharge openings with control of the discharge control means, ink is preliminarily discharged from the ink-discharge openings.

18. An image forming apparatus for forming an image on a recording medium by discharging ink from ink-discharge openings, comprising: a print head including ink-discharge surfaces having a plurality of rows of the ink-discharge openings formed therein for a corresponding plurality of colors; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in a direction orthogonal to the plurality of rows of the ink-discharge openings for the respective colors in accordance with the closing operation of the cap member while keeping the circumferential surface of the cleaning member in contact with the ink-discharge surfaces of the print head; drive control means for controlling the cap opening/closing means; and discharge control means for controlling a discharge operation of ink from the ink-discharge openings formed in the discharge surfaces, wherein, when the cap member is closed by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked, and in an order of the rows, over which the cleaning member passes with control of the discharge control means, of the ink-discharge openings for the corresponding colors formed in the ink-discharge surfaces, ink is preliminarily discharged from the ink-discharge openings with control of the discharge control means.

19. A control method of an image forming apparatus for forming an image on a recording medium by discharging ink front ink-discharge openings, the image forming apparatus comprising: a print head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head; drive control means for controlling the moving means; a cap member for protecting the ink-discharge surfaces of the print head; and cap opening/closing means for opening and closing the cap member, the control method comprising the step of controlling the image forming apparatus such that, when the cap member is opened by the cap opening/closing means, by driving the moving means with control of the drive control means so as to effect relative motion between the cleaning member and the print head while keeping the circumferential surface of the cleaning member in contact with the ink-discharge surfaces, ink in the ink-discharge openings is sucked.

20. The control method of an image forming apparatus according to claim 19, wherein the cap member is opened and closed when the closing state of the cap member has continued for a predetermined time interval.

21. The control method of an image forming apparatus according to claim 19, wherein the cap member is closed after an operation of forming an image on a recording sheet.

22. The control method of an image forming apparatus according to claim 19, wherein the cap member is closed unless an image forming operation is performed for a predetermined time interval after an operation of forming an image on a recording sheet.

23. A control method of an image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; moving means for effecting relative motion between the cleaning member and the print head other while keeping the circumferential surface of the cleaning member in contact with the ink-discharge surfaces of the print head; drive control means for controlling the moving means; discharge control means for controlling an discharge operation of ink from the ink-discharge openings formed in the discharge surfaces; a cap member for protecting the ink-discharge surfaces of the print head; and cap opening/closing means for opening and closing the cap member, the control method comprising the step of controlling the image forming apparatus such that, when the cap member is opened by the cap opening/closing means, by driving the moving means with control of the drive control means so as to effect relative motion between the cleaning member and the print head while keeping the circumferential surface of the cleaning member in contact with the ink discharge surfaces, ink in the ink-discharge openings is sucked, and after the moving of the cleaning member on the ink-discharge surfaces, ink is preliminarily discharged from the ink-discharge openings with control of the discharge control means.

24. A control method of an image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head; drive control means for controlling the moving means; discharge control means for controlling an discharge operation of ink from the ink-discharge openings formed in the discharge surfaces; a cap member for protecting the ink-discharge surfaces of the print head; and cap opening/closing means for opening and closing the cap member, the control method comprising the step of controlling the image forming apparatus such that, when the cap member is opened by the cap opening/closing means, by performing a discharge operation of ink from the ink-discharge openings with control of the discharge control means, ink is preliminarily discharged from the ink-discharge openings.

25. A control method of a image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; a cap member for housing the cleaning member therein and for protecting the ink-discharge surfaces of the print head;

cap opening/closing means for opening and closing the cap member and for effecting relative motion between the cleaning member and the print head in accordance with the opening operation of the cap member while keeping the circumferential surface of the cleaning member in contact with the ink-discharge surfaces of the print head; and drive control means for controlling the cap opening/closing means; the control method comprising the step of controlling the image forming apparatus such that, when the cap member is opened by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked.

26. A control method of an image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the opening operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces; the control method comprising the step of controlling the image forming apparatus such that, when the cap member is opened by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

27. A control method of an image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the opening operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces, the control method comprising the step of controlling the image forming apparatus such that, when the cap member is opened by the cap opening/closing means, by performing a discharge operation of ink from the ink-discharge openings with control of the discharge control means, ink is preliminarily discharged from the ink-discharge openings.

28. A control method of an image forming apparatus for forming an image on a recording medium by discharging ink from ink-discharge openings, the image forming apparatus comprising: a print head including ink-discharge surfaces having a plurality of rows of the ink-discharge openings formed therein for a corresponding plurality of colors; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in a direction orthogonal to the plurality of rows of the ink-discharge openings for the respective colors in accordance with the opening operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surface, the control method comprising the step of controlling the image forming apparatus such that, when the cap member is opened by the cap opening/closing means, by driving the cap opening/closing means will control of the drive control means so as to effect relative motion between the cleaning member and the print head while keeping the circumferential surface of the cleaning member in contact with the ink-discharge surfaces, ink in the ink-discharge openings is sucked, and in an order of the rows, over which the cleaning member passes with control of the discharge control means, of the ink-discharge openings for the corresponding colors formed in the ink-discharge surfaces, ink is preliminarily discharged from the ink-discharge openings with control of the discharge control means.

29. A control method of an image forming apparatus for forming an image on a recording medium by discharging ink from ink-discharge openings, the image forming apparatus comprising; a print head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head; drive control means for controlling the moving means; a cap member for protecting the ink-discharge surfaces of the print head; and cap opening/closing means for opening and closing the cap member, the control method comprising the step of controlling the image forming apparatus such that, when the cap member is closed by the cap opening/closing means, by driving the moving means with control of the drive control means so as to effect relative motion between the cleaning member and the print head while keeping the circumferential surface of the cleaning member in contact with the ink-discharge surfaces, ink in the ink-discharge openings is sucked.

30. A control method of an image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head; drive control means for controlling the moving means; discharge control means for controlling an discharge operation of ink from the ink-discharge openings formed in the discharge surfaces; a cap member for protecting the ink-discharge surfaces of the print head; and cap opening/closing means for opening and closing the cap member, the control method comprising the step of controlling the image forming apparatus such that, when the cap member is closed by the cap opening/closing means, by driving the moving means with control of the drive control means so as to effect relative motion between the cleaning member and the print head while keeping the circumferential surface of the cleaning member in contact with the ink-discharge surfaces, ink in the ink-discharge openings is sucked, and after the moving of the cleaning member on the ink-discharge surfaces, ink is preliminarily discharged from the ink-discharge openings with control of the discharge control means.

31. A control method of an image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; moving means for effecting relative motion between the cleaning member and the print head while keeping the circumferential surface of the cleaning member in contact with the ink-discharge surfaces of the print head, drive control means for controlling the moving means; discharge control means for controlling an discharge operation of ink from the ink-discharge openings formed in the discharge surfaces; a cap member for protecting the ink-discharge surfaces of the print head; and cap opening/closing means for opening and closing the cap member, the control method comprising the step of controlling the image forming apparatus such that, when the cap member is closed by the cap opening/closing means, by performing a discharge operation of ink from the ink-discharge openings with control of the discharge control means, ink is preliminarily discharged from the ink-discharge openings.

32. A control method of an image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening end closing the cap member and for effecting relative motion between the cleaning member and the print head in accordance with the closing operation of the cap member while keeping the circumferential surface of the cleaning member in contact with the ink-discharge surfaces of the print head; and drive control means for controlling the cap opening/closing means; the control method comprising the step of controlling the image forming apparatus such that, when the cap member is closed by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked.

33. A control method of an image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the closing operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces; the control method comprising the step of controlling the image forming apparatus such that, when the cap member is closed by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked, and after the, moving of the cleaning member on the ink-discharge surfaces, ink is preliminarily discharged from the ink-discharge openings with control of the discharge control means.

34. A control method of an image forming apparatus for forming an image on a recording medium by discharging ink from ink-discharge openings, the image forming apparatus comprising: a print head including ink-discharge surfaces having the ink-discharge openings formed therein; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in accordance with the closing operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces, the control method comprising the step of controlling the image forming apparatus such that, when the cap member is closed by the cap opening/closing means, by perforating a discharge operation of ink from the ink-discharge openings with control of the discharge control means, ink is preliminarily discharged from the ink-discharge openings.

35. A control method of an image forming apparatus for forming an image on a recording medium by discharging ink from ink-discharge openings, the image forming apparatus comprising: a print head including ink-discharge surfaces having a plurality of rows of the ink-discharge openings formed therein for a corresponding plurality of colors; a cylindrical cleaning member composed of an elastic material; a cap member for housing the cleaning member therein and for protecting the ink-discharge surfaces of the print head; cap opening/closing means for opening and closing the cap member and for effecting relative motion between the cleaning member and the print head in a direction orthogonal to the plurality of rows of the ink-discharge openings for the respective colors in accordance with the closing operation of the cap member while keeping the circumferential surface of the cleaning member in contact with the ink-discharge surfaces of the print head; drive control means for controlling the cap opening/closing means; and discharge control means for controlling an discharge operation of ink from the ink-discharge openings formed in the discharge surfaces, the control method comprising the step of controlling the image forming apparatus such that, when the cap member is closed by the cap opening/closing means, by driving the cap opening/closing means with control of the drive control means so as to effect relative motion between the cleaning member and the print head while keeping the circumferential surface of the cleaning member in contact with the ink-discharge surfaces, ink in the ink-discharge openings is sucked, and in an order of the rows, over which the cleaning member passes with control of the discharge control means, of the ink-discharge openings for the corresponding colors formed in the ink-discharge surfaces, ink is preliminarily discharged from the ink-discharge openings with control of the discharge control means.

* * * * *